US006487735B1

(12) United States Patent
Jacques, II et al.

(10) Patent No.: US 6,487,735 B1
(45) Date of Patent: Dec. 3, 2002

(54) BED ENCLOSURE

(75) Inventors: William L. Jacques, II, Batesville, IN (US); Gregory W. Branson, Batesville, IN (US); John W. Koenig, Cincinnati, IN (US); Kenneth L. Kramer, Greensburg, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/487,954

(22) Filed: Jan. 19, 2000

Related U.S. Application Data

(60) Provisional application No. 60/116,728, filed on Jan. 22, 1999.

(51) Int. Cl.[7] ..... A47C 21/08; A61G 7/05

(52) U.S. Cl. ..... 5/424; 5/425; 5/427; 5/428; 5/512

(58) Field of Search ..... 5/284, 414, 424, 5/425, 427, 428, 512, 97

(56) References Cited

U.S. PATENT DOCUMENTS

| | | | | |
|---|---|---|---|---|
| 544,381 A | | 8/1895 | Russell | |
| 654,972 A | | 7/1900 | Haack | |
| 1,021,930 A | | 4/1912 | Jackson | |
| 1,087,806 A | | 2/1914 | Miller | |
| 2,014,205 A | | 9/1935 | Linden | |
| 2,130,703 A | | 9/1938 | Wylie et al. | |
| 3,514,795 A | | 6/1970 | Beeman | |
| 3,763,507 A | | 10/1973 | Propst | |
| D231,874 S | | 6/1974 | Weigel et al. | |
| 4,641,387 A | | 2/1987 | Bondy et al. | |
| 4,782,541 A | | 11/1988 | Tuchman | |
| 4,953,246 A | | 9/1990 | Matthews | |
| 4,959,878 A | | 10/1990 | Essek | |
| 5,111,543 A | | 5/1992 | Epshetsky et al. | |
| D335,589 S | | 5/1993 | Benedict | |
| 5,359,740 A | | 11/1994 | Markley et al. | |
| 5,384,925 A | | 1/1995 | Vail | |
| 5,662,132 A | | 9/1997 | Larsen | |
| 5,784,732 A | | 7/1998 | Vail | |
| 5,987,666 A | * | 11/1999 | Zigmount | 5/424 |
| 6,216,291 B1 | * | 4/2001 | Eads et al. | 5/424 |
| 6,263,529 B1 | * | 7/2001 | Chadwick et al. | 5/424 |

* cited by examiner

*Primary Examiner*—Michael F. Trettel
(74) *Attorney, Agent, or Firm*—Bose McKinney & Evans LLP

(57) ABSTRACT

A bed enclosure for use with a hospital bed having a frame is disclosed having a shell and a skeletal structure configurable between an open position providing access between the interior and exterior of the shell and a closed position in which the shell forms a complete enclosure. Various pockets, pouches and slots formed in the shell are disclosed to facilitate display of documentary information, retention of personal items, access to controllers, passage of I.V. tubes, and receipt of bumpers or cushions. The bed enclosure is adapted to facilitate vertical adjustment of the intermediate frame relative to the frame of the bed and articulation of the articulating deck of the bed.

33 Claims, 24 Drawing Sheets

BED ENCLOSURE

This application claims the benefit of U.S. provisional application Ser. No. 60/116,728 filed Jan. 22, 1999.

BACKGROUND AND SUMMARY OF THE INVENTION

This invention relates to patient restraints and in particular to enclosures for beds in care giving facilities which restrict a patient's activities to the bed while allowing free movement of the patient within the bed.

Many patients in health care facilities suffer from mental or physical conditions which require that they be restricted to their beds for their own and others' safety. Generally, patients that require restraints are non-cognizant, injury prone, or excessively active as in the case of seizure patients. Patients who present aggressiveness, cognizant impairment, susceptibility to falls, and night time confusion are likely candidates for restriction. One commonly practiced restrictive procedure is to provide such patients with a full-time sitter who can prevent the patient from attempting to leave the bed or move about the room. This, of course, can result in a substantial increase in the health care costs resulting from increased labor charges. Alternatives to a full-time sitter are physical or chemical restraints which inhibit patient movement from the bed. Physical and chemical restraints can adversely affect the physical and mental condition of a patient being so restrained which can inhibit healing.

An alternative restrictive procedure is to provide a bed enclosure which allows free movement of the patient within the bed but prohibits the patient from leaving the bed. Patients diagnosed with Alzheimer's disease, closed head injuries, neurological defects, and strokes often benefit from bed enclosures as they are protected from injury caused by bed falls, entrapment in side rails, and accidents occurring while wandering from the bed. Presently available bed enclosures are typically free-standing mesh type cages with zippered flaps which may be unzipped and thrown on the roof of the enclosure to allow care giver access to the patient. Such enclosures inhibit movement of the bed to a different location, interfere with the articulation of the bed, interfere with raising and lowering the bed, interfere with medical devices being used to provide care to the patient (especially drainage devices such as foley catheters from which the patient must be disconnected to exit the bed enclosure), interfere with the patient's control of the bed, and/or are difficult for the care giver to configure so that care can be provided to the patient.

Caregivers in health care facilities would welcome a patient restraint system which provides the patient with free movement within the bed but limits the patient's movement to the bed yet allows movement of the bed from location to location, height adjustment of the bed, and articulation of the bed by the patient and caregiver. Health care facilities and caregivers would also welcome a bed enclosure which would not inhibit the use of medical devices necessary for providing patient care and is configurable to provide only the restraint necessary for the particular patient.

According to the present invention, the bed enclosure includes a series of sidewalls extending upwardly from the bed frame and a roof. At least one sidewall of such bed enclosure includes a vertically adjustable curtain which is configurable between a closed position, an open position, and a plurality of intermediate positions. Curtain includes a top fastener for securing the curtain in the closed position.

In preferred embodiments the bed enclosure is mounted to the frame of the bed.

According to the present invention, a bed enclosure for use with a hospital bed having a frame, an intermediate frame vertically adjustable relative to the frame, an articulating deck pivotally mounted to the intermediate frame, and a mattress, comprises a shell and a skeletal structure supporting the shell and being attached to the intermediate frame of the bed. The shell includes a roof, a bottom panel, a wall connected to and extending between the bottom panel and the roof, and a curtain formed in the wall. The curtain is movable relative to a remainder of the wall between a lowered position to form an opening providing access between the interior and exterior of the shell and a raised position in which the shell forms a complete enclosure. The bottom panel of the shell may rest on and extend across the articulating deck with the mattress resting on the bottom panel while the curtain is movable between the lowered position in which a top edge of the curtain is below a top surface of the mattress of the bed to which the bed enclosure is attached and the raised position in which the shell forms a complete enclosure within which the mattress is received. The enclosure may include an I.V. slot formed in the wall of the shell adjacent to the movable curtain to allow a patient with an I.V. attached to enter and exit the bed to which the shell of the bed enclosure is attached without removal of the I.V. from the patient. Closure of the shell may be accomplished with a zipper having a first row of teeth attached to the top edge of the curtain and a second row of teeth attached to the remainder of the wall so that the zipper secures the top edge to the remainder of the wall when the curtain is in the raised position. A sensor for producing an illumination signal when the zipper is not fully closed and a light coupled to the shell which is illuminated when the sensor produces the illumination signal may also be provided. The skeletal structure may include telescoping cross-members configured to alter the length of the skeletal structure in response to an alteration in the length of the intermediate frame.

According to another embodiment of the present invention the bed enclosure for use with a hospital bed to restrain movement of a patient includes a shell located over the bed to restrain the patient, a timer coupled to the shell, and a reset button for reinitializing the timer. The timer may count up from zero each time the reset button is pressed.

A bed enclosure for use with a hospital bed to restrain movement of a patient in accordance with the present invention includes a shell having a side wall, an access curtain, and a zipper for securing the access curtain to the side wall so that the enclosure is in a closed state, and a light indicating the state of the enclosure. The enclosure may include a sensor for producing an illumination signal when the zipper is not fully closed and a light coupled to the sensor so that the light is illuminated when the sensor produces the illumination signal. The enclosure may include a first and second opposite side walls, each side wall including an access curtain coupled to the side wall by a zipper, and first and second lights located adjacent the first and second side walls to indicate the state of the enclosure and first and second sensors located adjacent the first and second zippers for producing illumination signals when the zippers are not fully closed, the first and second lights being coupled to each of the first and second sensors so that both the first and second lights are illuminated when either of the first or second zippers is open.

A bed enclosure for use with a hospital bed to restrain movement of a patient in accordance with the present invention includes a shell located over the bed to restrain the patient, the shell including a side wall and an access curtain coupled to the side wall. The curtain is movable relative to a remainder of the wall to form an opening to provide access to an interior region of the shell. The curtain is formed to include a patient access port and a mechanism for closing the patient access port. The patient access port may be closed by a zipper. A pad may be connected to the inside of the curtain to block patient access to the zipper. Also, the patient access port may have an arcuate shaped opening.

In accordance with another aspect of the invention, a bed enclosure for use on a hospital bed includes a shell a shell located over the bed to restrain a patient on the bed. The shell includes a wall and a curtain coupled to the wall. The curtain is movable relative to the remainder of the wall between a lowered position to form an opening providing access to an interior region of the shell and a raised position in which the shell forms a complete bed enclosure. The wall is formed to include a slot adjacent the curtain which is slot configured to receive tubes which are attached to the patient so that the patient can enter and exit the bed through the bed enclosure without removing the tubes from the patient.

A bed enclosure for use on a hospital bed according to yet another aspect of the invention includes a shell located over the bed to restrain a patient on the bed. The shell includes a foot end, a roof, a wall and a curtain coupled to the wall.

The curtain is movable relative to the remainder of the wall between a lowered position to form an opening providing access to an interior region of the shell and a raised position in which the shell forms a complete bed enclosure. The foot end of the shell includes a transparent panel.

According to another aspect of the present invention, a bed enclosure for use on a hospital bed includes a shell located over the bed to restrain a patient on the bed. The shell includes a wall and a flap coupled to the wall, the flap being movable relative to the wall between an open position to form an opening providing access to an interior region of the shell and a closed position in which the shell forms a complete bed enclosure. The wall is formed to include a port configured to receive tubes which are attached to the patient so that the patient can enter and exit the bed through the bed enclosure without removing the tubes for the patient. The bed enclosure may include a top surface formed to include a transparent section and have a camera mounted adjacent the transparent portion for providing images to a monitor of the interior of the bed enclosure.

A bed enclosure for use on a hospital bed according to one aspect of the present invention includes a shell located over the bed to restrain a patient on the bed. The shell includes a wall and a curtain coupled to the wall, the curtain being movable relative to the remainder of the wall between an open position to form an opening providing access to an interior region of the shell and a closed position in which the shell forms a complete bed enclosure. The wall is formed to include pouches extending into the interior of the enclosure with openings accessible from the exterior of the enclosure. The enclosure may include pillows inserted through the opening into the pouch.

A bed enclosure for use on a hospital bed according to another aspect of the invention includes a shell and a skeletal structure supporting the shell. The shell includes a wall formed to include a curtain movable relative to the remainder of the wall between an open position to form an opening providing access between the interior and the exterior of the shell and a closed position in which the shell forms a complete enclosure. A repositioning device is coupled to the skeletal structure and positioned to facilitate repositioning of a patient received on the bed.

According to another aspect of the present invention, a bed enclosure for use with a hospital bed to restrain movement of a patient includes a shell and a skeletal structure supporting the shell. The shell is configurable between a first configuration in which the shell entirely encloses the bed and a second configuration allowing access to the bed. Patient assist rails extend from the skeletal structure to facilitate patient ingress and egress.

According to yet another aspect of the invention, a bed enclosure for use with a hospital bed to restrain movement of a patient includes a shell having a sidewall, a skeletal structure supporting the shell, and an external pouch coupled to the shell having an opening accessible from the exterior of the shell. The pouch may be sized to receive a video cassette. The enclosure may include a plurality of exterior pouches having openings accessible from the exterior of the bed enclosure, one of which is formed to include a transparent document window and sized to receive a document.

Features and advantages of the invention will become apparent to those skilled in the art upon consideration of the following description of an illustrated embodiment exemplifying the best mode of carrying out the invention as presently perceived.

BRIEF DESCRIPTION OF THE DRAWINGS

FIG. 13 is a perspective view of an alternative embodiment bed enclosure showing mesh pouches into which standard-size pillows are inserted to provide a padded barrier between the patient and the siderails and end boards of the bed;

FIG. 14 is a perspective view of an alternative bed enclosure feature showing mesh pockets coupled to a sidewall of the bed enclosure and configured to receive personal belongings of the patient;

FIG. 15 is a perspective view of an alternative embodiment bed enclosure showing a repositioning bar coupled to a top portion of the bed enclosure frame and hanging downwardly therefrom at a location that facilitates patient repositioning;

FIG. 16 is a perspective view of an alternative embodiment bed enclosure showing a pair of patient assist rails coupled to portions of the bed enclosure frame and extending transversely from the bed to assist a patient in exiting and entering the bed;

FIG. 17 is a perspective view of an alternative embodiment bed enclosure showing an IV port coupled to a mesh sidewall of the bed enclosure;

FIG. 18 is a perspective view of an alternative embodiment bed enclosure showing a zippered port formed in a non-mesh portion of the sidewall of the bed enclosure and showing a cable of a pendant controller routed through the zippered port so that the pendant controller is accessible in the interior region of the bed enclosure;

FIG. 19 is an enlarged perspective view of the zippered port of FIG. 18 showing a grommet fastened to the cable of the pendant controller to limit the amount of cable positioned in the interior region of the bed enclosure;

FIG. 20 is a perspective view of an alternative embodiment bed enclosure showing a transparent window included in the roof of the bed enclosure and showing a video camera mounted to the bed enclosure and aimed at a patient through the transparent window;

FIG. 21 is a perspective view of a caregiver station showing a video screen displaying an image received from the video camera of FIG. 20 and showing a caregiver remotely monitoring the patient restrained by the bed enclosure of FIG. 20;

FIG. 22 is a perspective view of an alternative embodiment bed enclosure showing, diagrammatically, a pair of videocassettes that are received in pouches of the bed enclosure located at a foot end of a bed and showing a notice label attached to a non-mesh portion of the sidewall of the bed enclosure to notify family members of a patient that the bed enclosure is an alternative to more restrictive restraints;

FIG. 23 is a perspective view of an alternative embodiment bed enclosure showing a pocket formed in an end wall of the bed enclosure and showing a consent form received in the pocket to notify family members that the patient, or the patient's legal guardian, has consented to the use of the bed enclosure to restrain the patient;

FIG. 24 is a perspective view of an alternative embodiment bed enclosure showing the bed enclosure including an arched roof, the sidewalls including upper and lower roll-up portions, and the upper and lower roll-up portions including rails that move in the directions of the double arrows from an opened position toward one another to a closed position;

FIG. 25 is a perspective view of an alternative embodiment bed enclosure showing the roof of the bed enclosure including an arched transparent sheet and a roll-up sidewall of the bed enclosure being constructed of a hybrid mesh material having a plurality of vertical translucent straps and a plurality of horizontal chord segments;

FIG. 26 is a perspective view of an alternative embodiment bed enclosure showing a sidewall of the bed enclosure having head end and foot end curtain portions that are guided by upper and lower tracks to move in the direction of the double arrows from a closed position to an opened position and showing an IV slot formed in a vertical rail of the head end curtain portion of the siderail;

FIG. 27 is a perspective view of an alternative embodiment bed enclosure showing two U-shaped frame members pivoted to a vertical position in which mesh sidewall and roof portions that are coupled to the respective U-shaped frame members are pulled taut to enclose a patient;

FIG. 28 is a side elevation view of the bed enclosure of FIG. 27 showing the U-shaped frame members pivoting in the direction of the double arrows to open the bed enclosure;

FIG. 29 is a perspective view of an alternative embodiment bed enclosure, similar to the bed enclosure of FIG. 27, showing two U-shaped frame members each having an arched roof strut, a signal light mounted to one of the U-shaped frame members for indicating that the U-shaped frame members are not locked together, and an access flap formed in a mesh sidewall;

FIG. 30 is a perspective view of an alternative embodiment bed enclosure showing the frame of the bed enclosure including tubular air bladders, an air-handling unit for inflating the air bladders mounted to a foot board of a bed to which the bed enclosure is mounted, and a plurality of collars mounted on the air bladders and coupled to mesh walls of the bed enclosure;

FIG. 31 is a perspective view of a frame of an alternative embodiment bed enclosure showing the frame including a plurality of telescoping frame members;

FIG. 32 is an enlarged perspective view of one of the frame members of FIG. 31 showing an outer frame member having a release button coupled thereto and showing an inner frame member formed to include a plurality of apertures that receive a locking pin to which the release button is coupled;

FIG. 33 is a perspective view of an alternative embodiment bed enclosure showing the sidewalls and end walls of the bed enclosure including a plurality of angled plastic slats and showing one of the sidewalls moved to an opened position in which hinged portions of the sidewall are folded together;

FIG. 34 is a perspective view of an alternative embodiment bed enclosure, similar to the bed enclosure of FIG. 33, showing a padded barrier coupled to the sidewalls and end walls of the bed enclosure and showing a CPR release handle that is actuated to rapidly lower a sidewall, the CPR release handle being coupled to an upper portion of one of the end walls;

FIG. 35 is a perspective view of an alternative embodiment bed enclosure showing an upper portion of one of the sidewalls including a CPR release handle and IV line slots on either side of the CPR release handle; and FIG. 36 is a perspective view of an alternative embodiment bed enclosure showing a CPR release handle that is actuated to lower all of the end walls and sidewalls simultaneously.

DETAILED DESCRIPTION OF THE DRAWINGS

Figure 1:
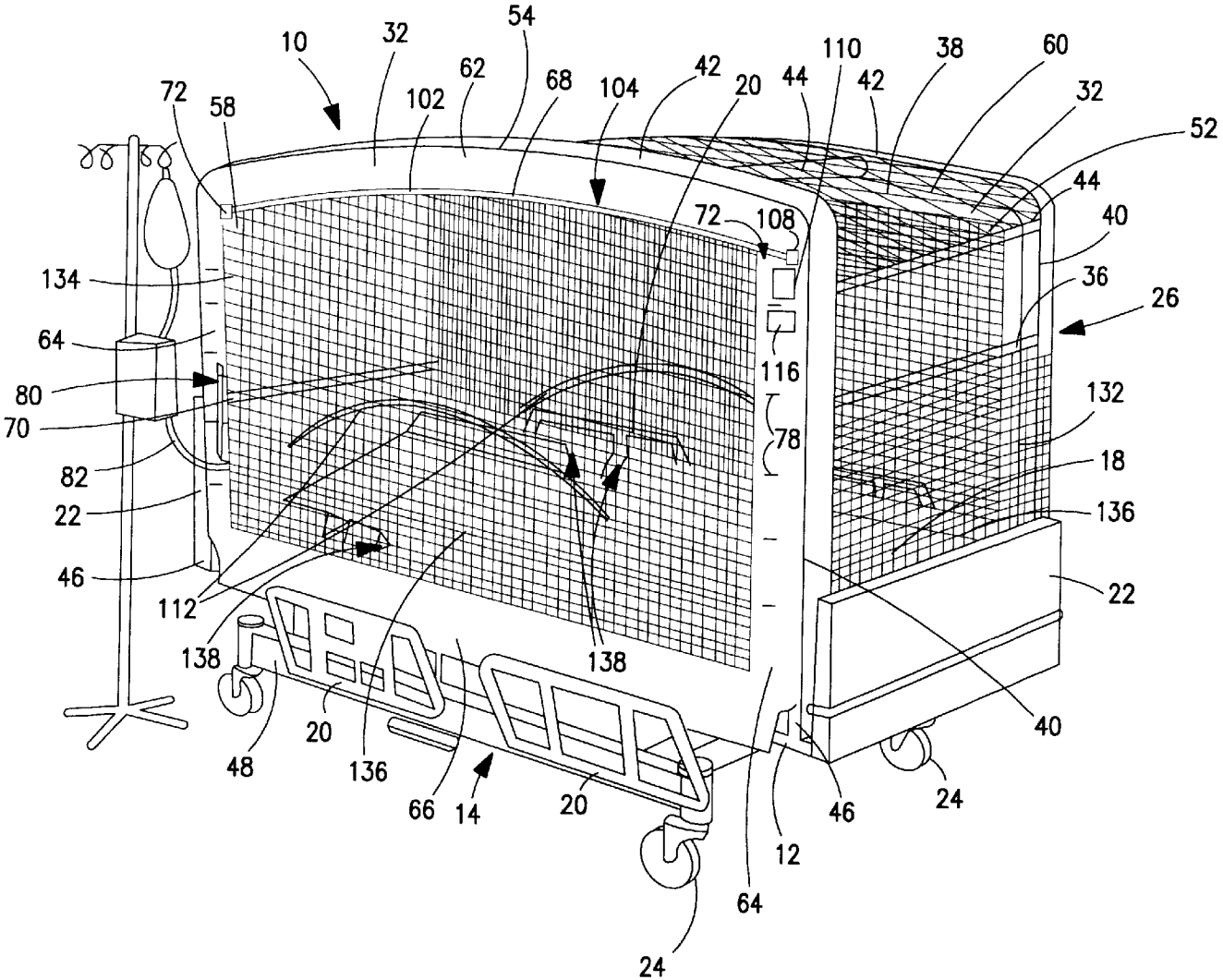
FIG. 1 is a perspective view of a hospital bed having an articulating deck and a frame on wheels and a bed enclosure in accordance with the present invention showing the enclosure attached to the intermediate frame of the bed so that the enclosure does not inhibit movement of the bed, showing an intravenous ("I.V.") stand holding an I.V. with an I.V. tube extending through an I.V. slot in the bed enclosure into the interior of the bed enclosure, and a side curtain of the bed enclosure fully extended and secured in place by a top zipper.
Figure 2:
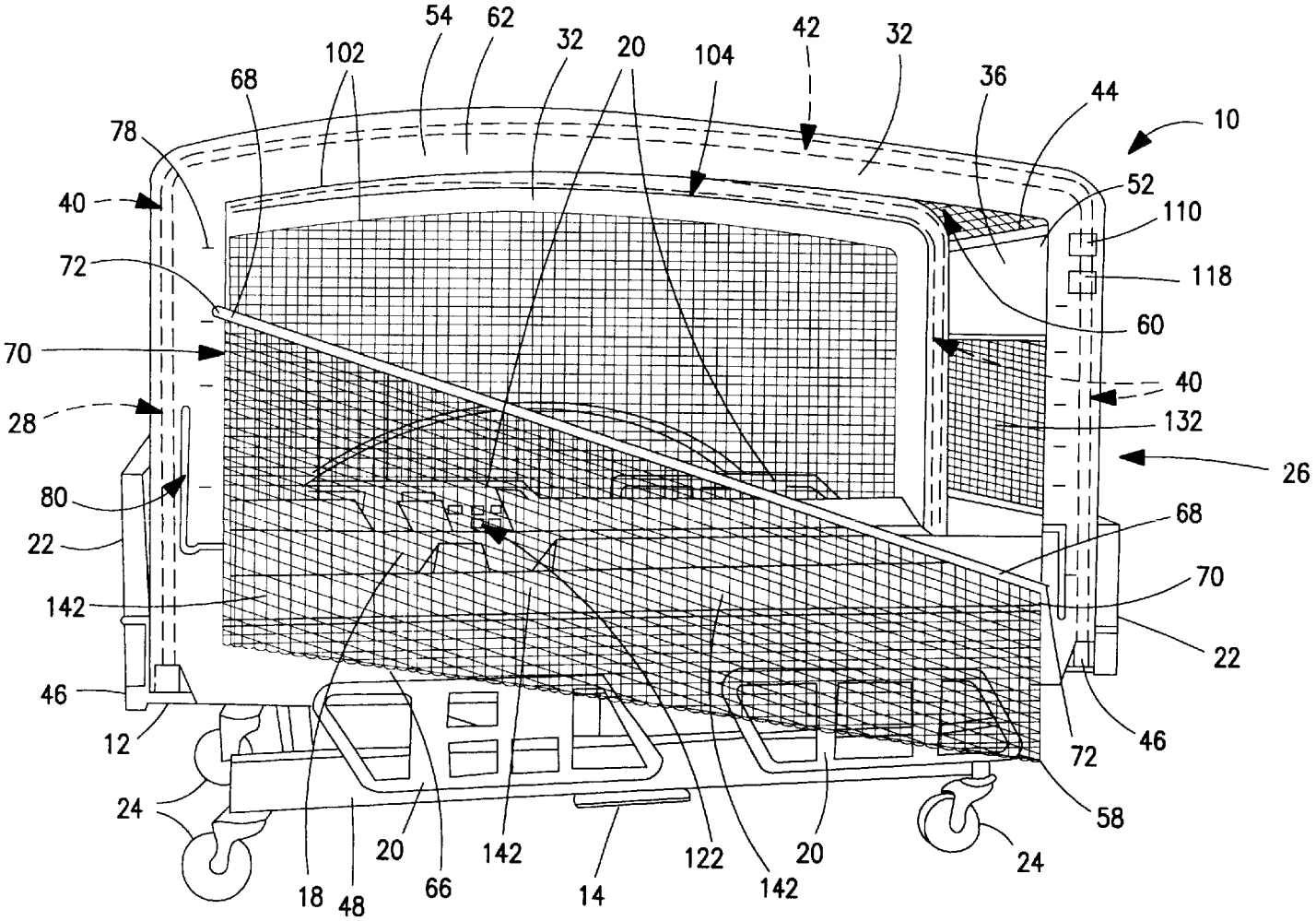
FIG. 2 is a perspective view of the bed enclosure of FIG. 1 showing the side curtain of the bed enclosure in a partially lowered state which would allow a care giver access to the patient yet continue to prevent the patient from accidentally falling out of the bed and also showing skeletal components of the bed enclosure in phantom lines.

When a hospital bed enclosure 10 in accordance with the present invention is fully closed patients are restricted to their beds but are allowed free movement therein. Bed enclosure 10 prevents bed falls, patient entrapment in side rails, and unsupervised wandering of the patient. Illustratively, bed enclosure 10 is made of a combination of vinyl, mesh, and clear plastic segments forming a complete enclosing shell 26 which is provided a box-like shape and stability by a skeletal structure 28. Bed enclosure 10 is configurable to allow care givers to attend to patients with a reduced risk of injury of the patient or injury of the care giver by the patient.

Bed enclosure 10 is designed so that skeletal structure 28 is mounted to intermediate frame 12 of a bed 14 having an articulating deck 16 so as not to inhibit vertical adjustment of bed 14, relocation of bed 14, or reconfiguration of articulating deck 16. When fully closed as shown in FIG. 1, bed enclosure 10 restricts patient to the surface of mattress 18 of bed 14 while allowing free movement within bed 14 thereby avoiding the adverse effects of physical or chemical restraints which completely inhibit patient movement.

Figure 3:
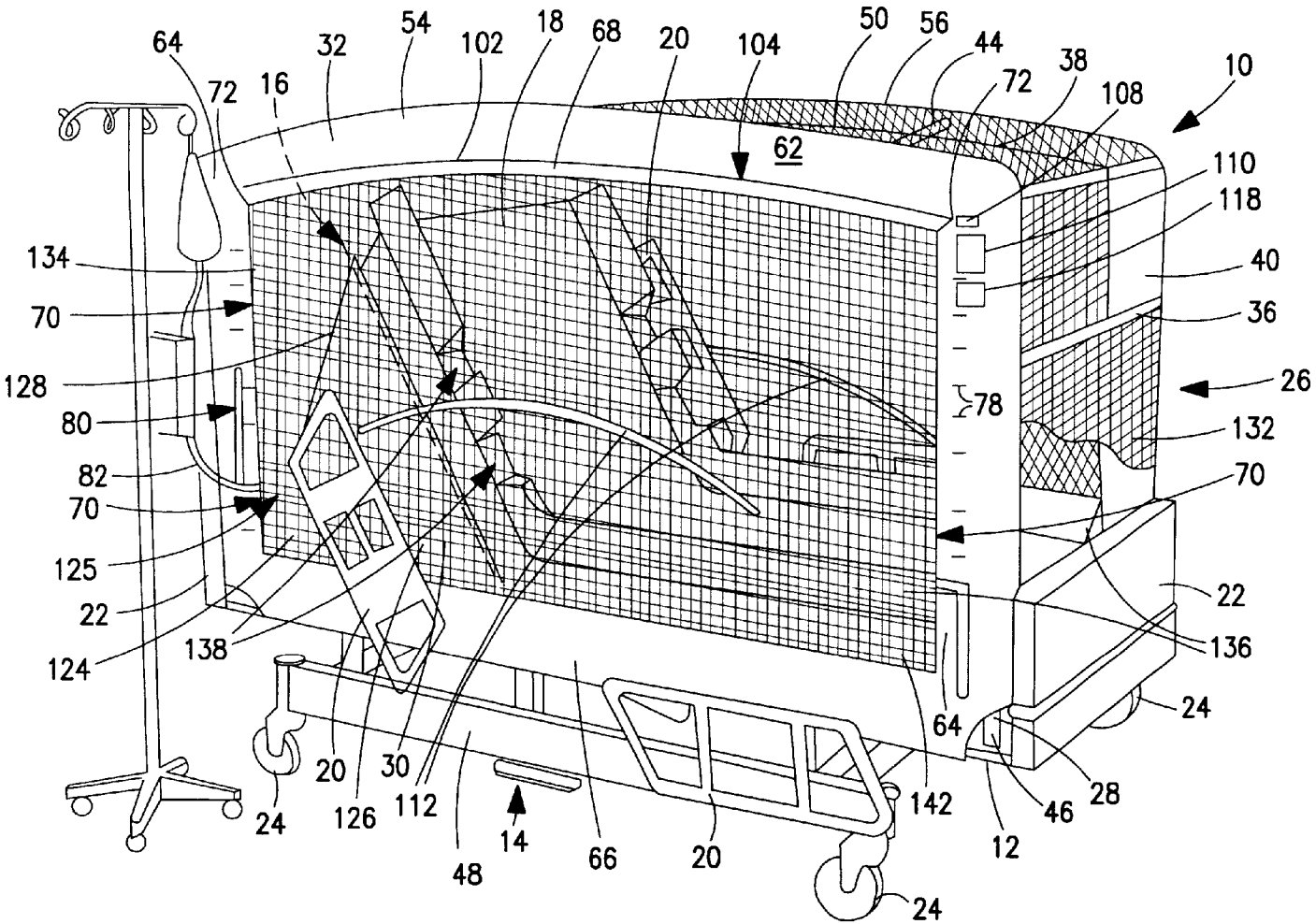
FIG. 3 is a perspective view of the bed enclosure of FIG. 1 showing the deck (shown in phantom lines) of the bed articulated to adjust the bed configuration and showing additional material attached to the bottom of the enclosure in the head area of the enclosure to facilitate articulation of the bed.
Figure 4:
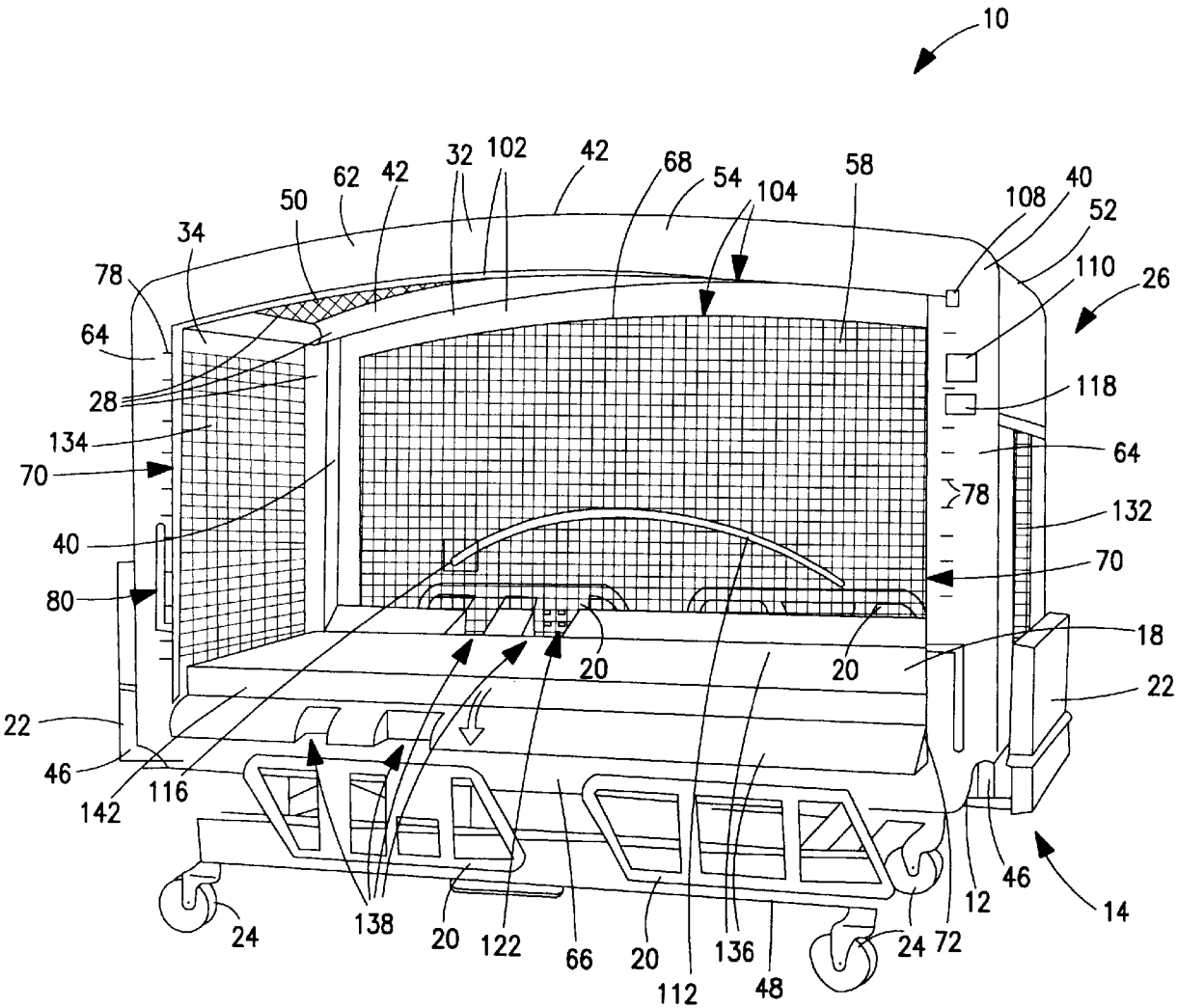
FIG. 4 is a perspective view of the bed and enclosure of FIG. 1 with one side curtain lowered to below the level of the mattress and a cushion rotated away from the bed surface to provide for easy ingress and egress of the patient.
Figure 5:
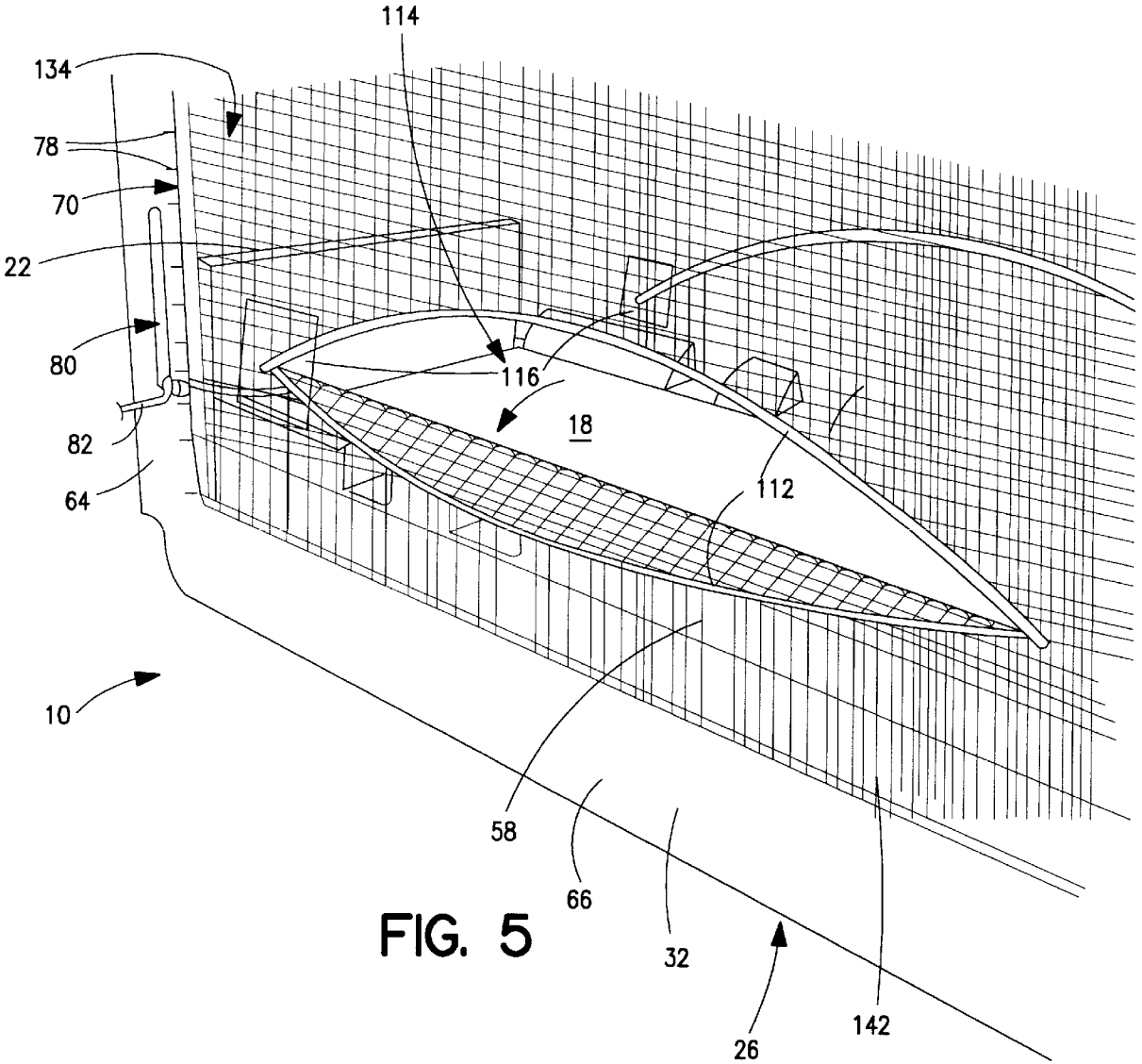
FIG. 5 is a closeup view of a portion of the bed enclosure of FIG. 1 showing a zippered access panel in the side curtain opened to allow a care giver access to the patient yet preventing the patient from easily leaving the bed.
Figure 11:
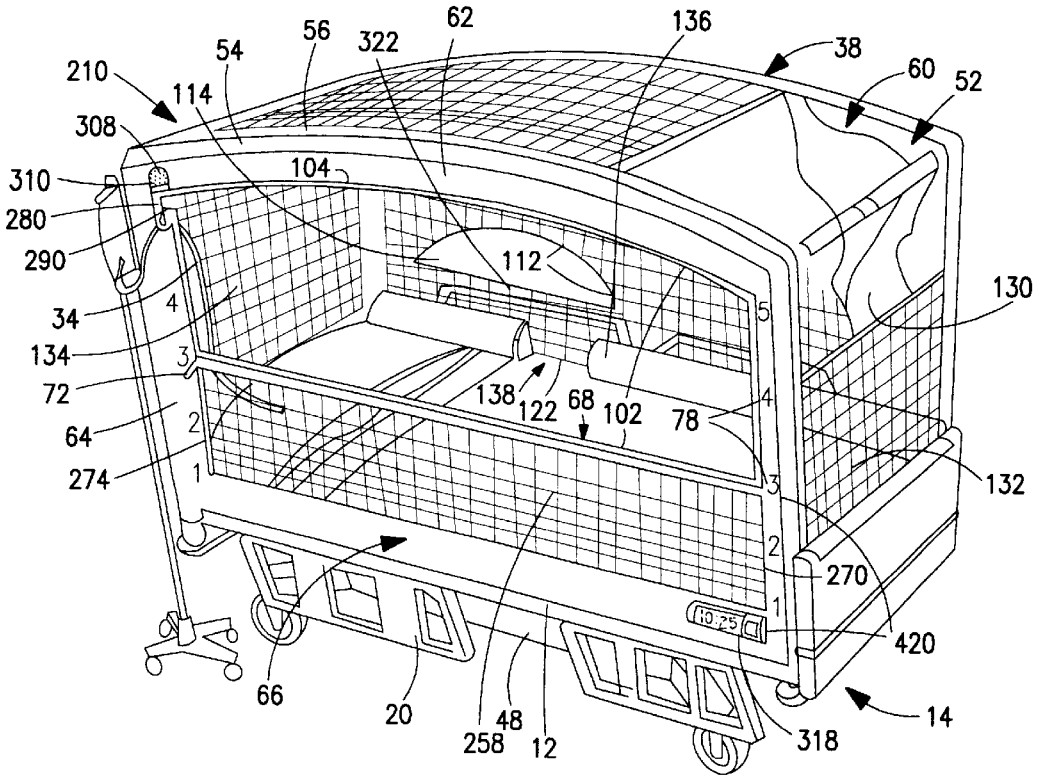
FIG. 11 is a perspective view of an alternative embodiment of a bed enclosure attached to a bed showing the sidewall of the bed enclosure partially retracted to provide access to a patient.

Referring now to FIGS. 1, 3 and 11, there is illustrated, a bed enclosure 10, for use with hospital bed 14 having an intermediate bed frame 12, a deck 16, mattress 18, side rails 20, and head and end rails 22. Side rails 20 of bed 14 are adjustable between a lowered position as shown, for example, on the near side of bed 14 in FIGS. 1–4, and a raised position as shown, for example, on the far side of bed 14 in FIGS. 1–4. Also, hospital bed 14 includes articulating deck 16 pivotally connected to intermediate frame 12 to allow reconfiguration of bed 14 between various patient accommodating and treatment facilitating positions including a flat position as shown in FIGS. 1, 2, 4–5 and a inclined position as shown, for example, in FIG. 3. Hospital bed 14 includes a "hi-lo" function making bed 14 vertically adjustable between a lowered position as shown in FIGS. 1–4 and a raised position as shown in FIG. 11. Hospital bed 14 is also provided with wheels or casters 24 to allow hospital bed 14 to be moved to different locations in the health care facility. Bed enclosure 10 is configured so that the hi-lo, deck articulation, and location adjustments of bed 14 are not inhibited by bed enclosure 10.

Bed enclosure 10 includes a shell 26 and a skeletal structure 28 to provide shape to shell 26. Shell 26 includes a bottom panel 30, two side walls 32, a head end wall 34, a foot end wall 36, and a top wall or roof 38. Skeletal structure 28 includes four vertically oriented support posts 40, two longitudinally extending cross members 42, and cross support 44. Illustratively skeletal structure 28 is formed from aluminum to provide a rigid lightweight skeletal structure 28, but it should be understood that other materials such as composites, fiberglass, wood, metal and the like may be used within the scope of the invention. As shown, for example, in FIG. 10, the components of skeletal structure 28 are enclosed in pads 47 to prevent patient injury from contact with skeletal structure. Pads 47 may be formed from foam rubber or polystyrene tubes or the like.

Figure 12:
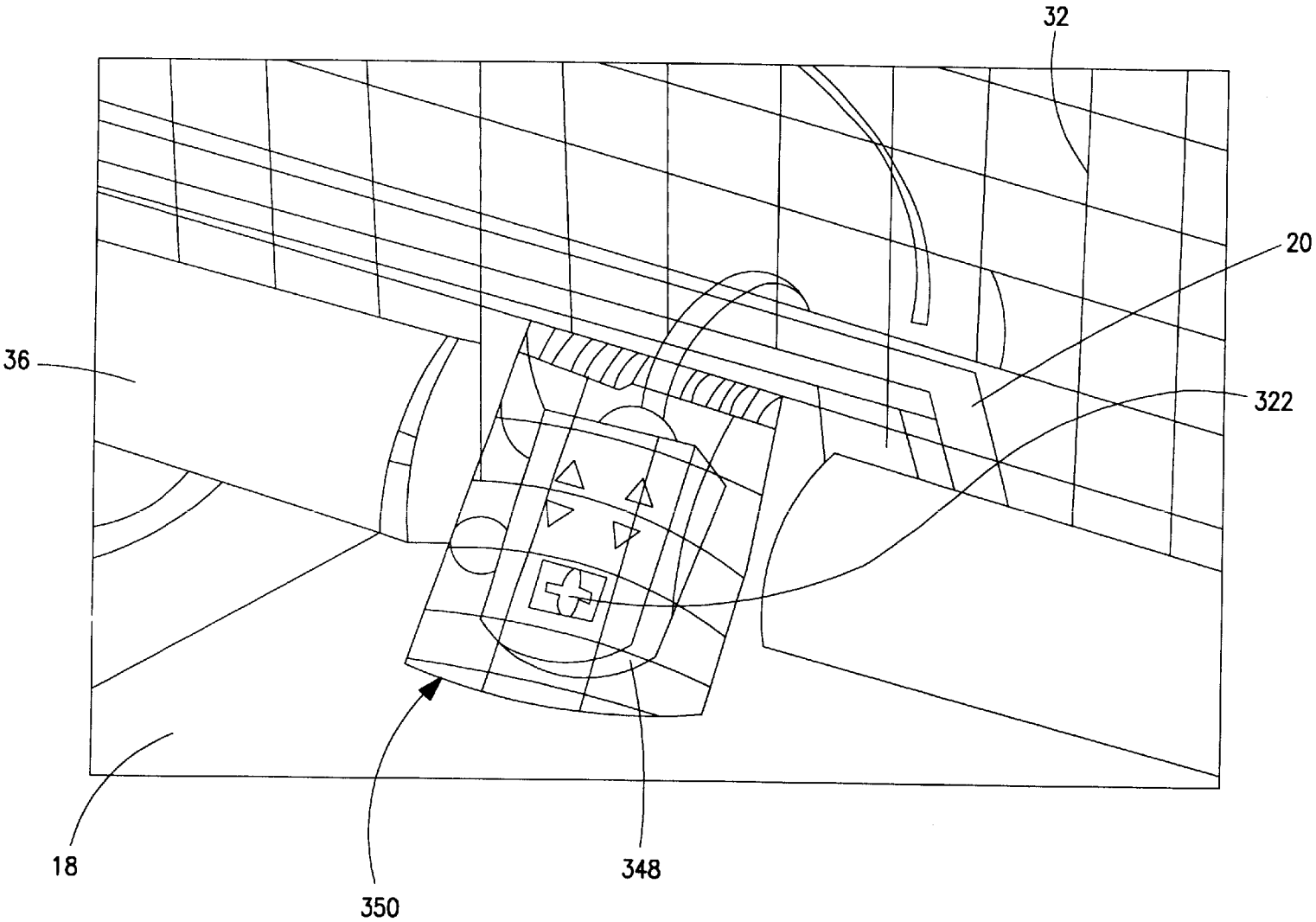
FIG. 12 is a perspective view of a pouch for holding a hand pendant bed controller for use with the bed enclosure of FIG. 11.

Rather than mounting bed enclosure 10 to the floor by separate stands surrounding bed 14, which would inhibit movement of the bed 14, bed enclosure 10 is directly mounted to intermediate frame 12 of bed 14. Prior to attaching bed enclosure 10 to bed 14, mattress 18 is removed from articulating deck 16. Support posts 40 are configured to be removably attached to intermediate frame 12 so that bottom panel 30 of shell 26 rests on deck 16 and extends across deck 16 below mattress 18. Illustratively, intermediate frame 12 includes four sockets 46 located near the four corners of frame 12 and is vertically adjustable relative to main frame 48. Sockets 46 are typically provided on hospital beds 14 to allow for attachment of traction mechanisms, I.V. stands and the like to bed 14. The illustrated bed enclosure 10 is configured to take advantage of the presence of sockets 46 to provide an attachment location for bed enclosure 10. Illustrated sockets 46 are tube sections extending vertically from intermediate frame 12, consequently posts 40 are configured to include an outside diameter which is slightly less than the inside diameter of socket 40 so that lower end of support posts 40 are received within sockets 46 when bed enclosure 10 is attached to bed 14 as shown, for example, in FIG. 12. Once bed enclosure 10 has been attached to bed 14, a mesh curtain 58 of side wall 32 is lowered and mattress 18 is placed on top of bottom panel 30 of shell 26 resting on articulating deck 16.

Vertically oriented support posts 40 extend upwardly from intermediate frame 12 and connect at the top to cross members 42 which are connected together by cross support 44 forming skeletal structure 28 of bed enclosure 10. Some hospital beds include intermediate frames that are configured to vary in overall length to facilitate articulation of the articulating deck. While the illustrated embodiment of bed enclosure 10 refers to one-piece cross-members 42, it is to be understood that cross-members 42 may be formed from two or more separate components telescopically connected to each other to adapt the bed enclosure 10 for use with a bed having a frame that varies in length during articulation of the deck.

Shell 26 is supported by skeletal structure 28 and consists of multiple segments. In the vicinity of support posts 40 and cross members 42, shell 26 is formed from vinyl or plastic material providing a durable material at the point of contact of shell 26 and skeletal structure 28, as shown, for example, in FIGS. 1–3. Extending between durable segment 54 surrounding cross members 42 is roof 38 which includes multiple segments including a roof portion 56 of durable segment 54, a mesh segment 50, and a roof portion 60 of clear segment 52 formed from clear plastic or vinyl. Mesh segment 50, and all other mesh segments 58, 132, 134 described herein, are illustratively made from nylon or other suitable material. Mesh segment 50 is preferably radio frequency ("RF") welded to roof portion 60 of clear segment 52 to provide for a secure attachment between the two segments 50, 52. Roof portion 56 of durable segment 54 is also preferably RF welded to both mesh segment 50 and roof portion 60 of clear segment 52 to form roof 38. While RF welding is the preferred method of attaching all of the component segments of shell 26 together, it should be understood that other methods appropriate for attaching fabrics together, such as sewing, gluing, or the like, are within the scope of the invention as disclosed.

Side walls 32 include a side wall portion 62 of durable segment 54, two upright durable segments 64, bottom durable segment 66 extending across the bottom of side wall 32, and a mesh curtain 58 which may be raised or lowered as shown, for example, in FIGS. 1–6. Mesh curtain 58 is attached to durable segment 66 along the bottom of side wall 32 by RF welding or the like. Mesh curtain 58 is configured to be raised and lowered so that when in the raised state patient movement is totally restricted to the interior of bed enclosure 10. Mesh curtain 58 may be fully raised, as shown, for example, in FIGS. 3, and 6, partially lowered to a plurality of intermediate states, as shown, for example, in FIGS. 2 and 11, or fully lowered to an open state, as shown, for example, in FIG.4. In open state, top 68 of mesh curtain 58 is below the top level of mattress 18 so that patient ingress and egress from bed 14 is not inhibited.

Sides 70 of mesh curtain 58 include handles 72 which run on vertically extending rods 74 connected to upright durable segments 64. Handles 72 on either side 70 of mesh curtain 58 can adjust the height of mesh curtain 58. Handles 72 include releases 76 which disengage stop mechanisms (not shown) which maintain handles 72 in user selected positions relative to rods 74. Sides 70 of mesh curtain 58 ride on rods 74. Each side 70 of mesh curtain 58 can be adjusted on its own from the beginning to the end of its range of motion before beginning to adjust the other side, as shown, for example, in FIG. 2.

The adjustable height of mesh curtain 58 can be a benefit to the patient and care giver by providing a method to keep the patient partially enclosed. For instance, when mesh curtain 58 is in a partially raised position, as shown for example in FIG. 11, it will be low enough to facilitate care giver activity while also preventing the patient from rolling out of bed 14. This partially raised curtain position would only be used for patients that are not at a high risk of climbing out.

A plurality of markings 78 are provided on both upright durable segments 64 of side wall 32 to provide a scale for adjusting the height of mesh curtain 58. The height adjustable mesh curtain 58 may be stopped at any location when being lowered and raised and is not required to stop at one of markings 78. Instead either handle 72 of mesh curtain 58 can be stopped anywhere in its range of travel by disengaging releases 76 of stopping mechanisms so that mesh curtain 58 can assume an almost unlimited number of adjustable rail configurations. Markings 78 simply provide a scale for aligning opposite sides of curtain if alignment is desired.

Figure 7:
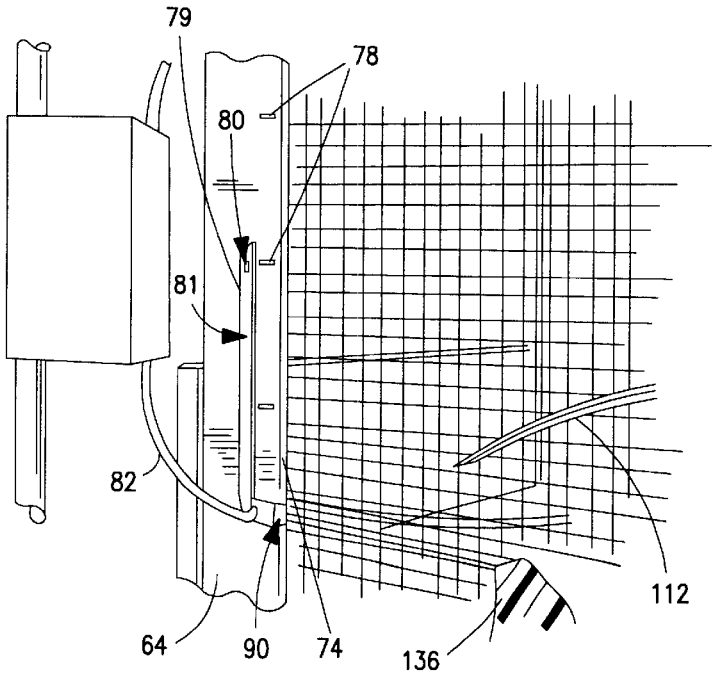
FIG. 7 is a closeup perspective view of the I.V. tube passing through the I.V. slot in the bed enclosure.
Figure 8:
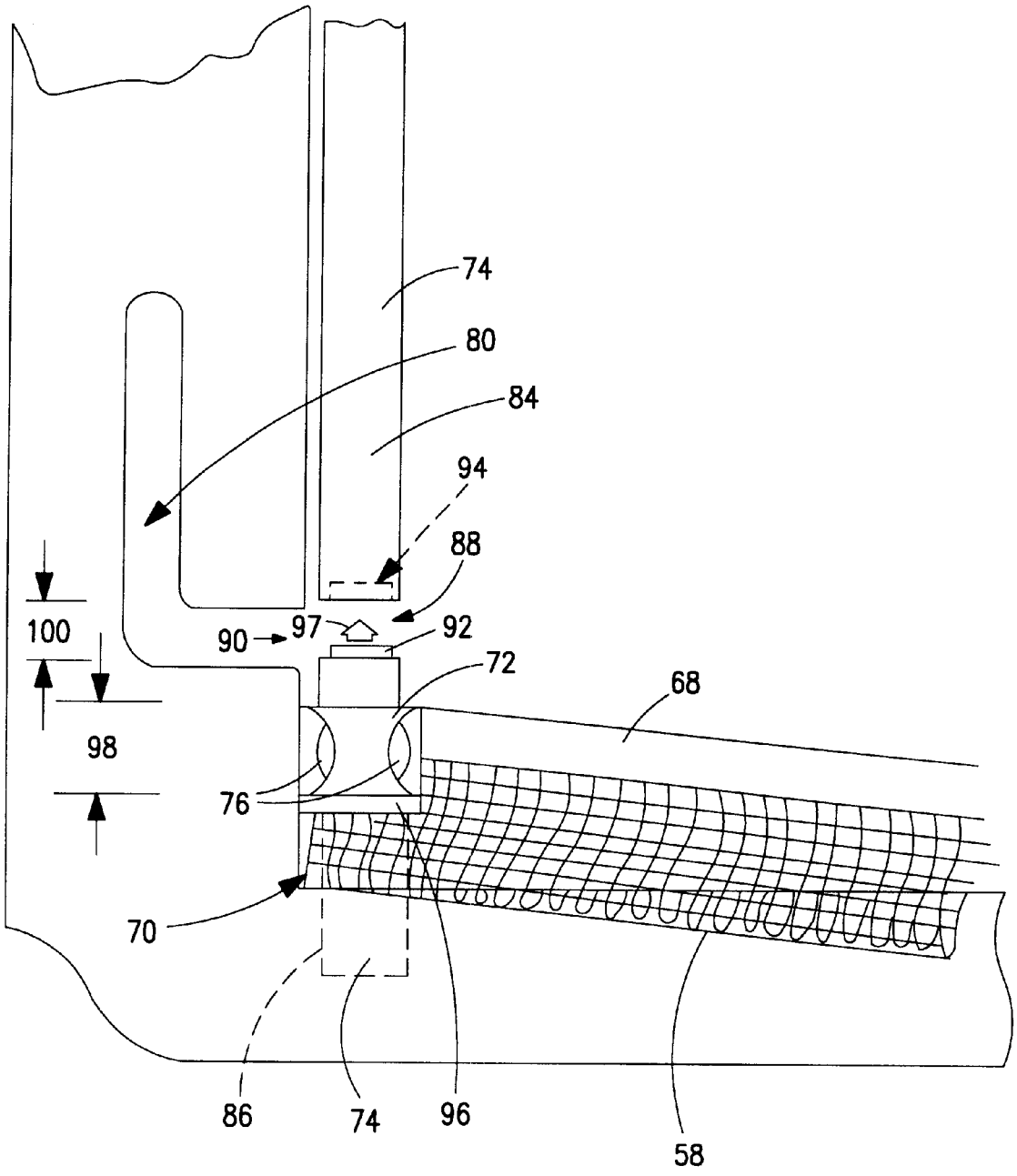
FIG. 8 is plan view of a latch which allows an I.V. tube attached to a patient to be inserted into the I.V. slot without removal of the I.V. tube from the patient.
Figure 9:
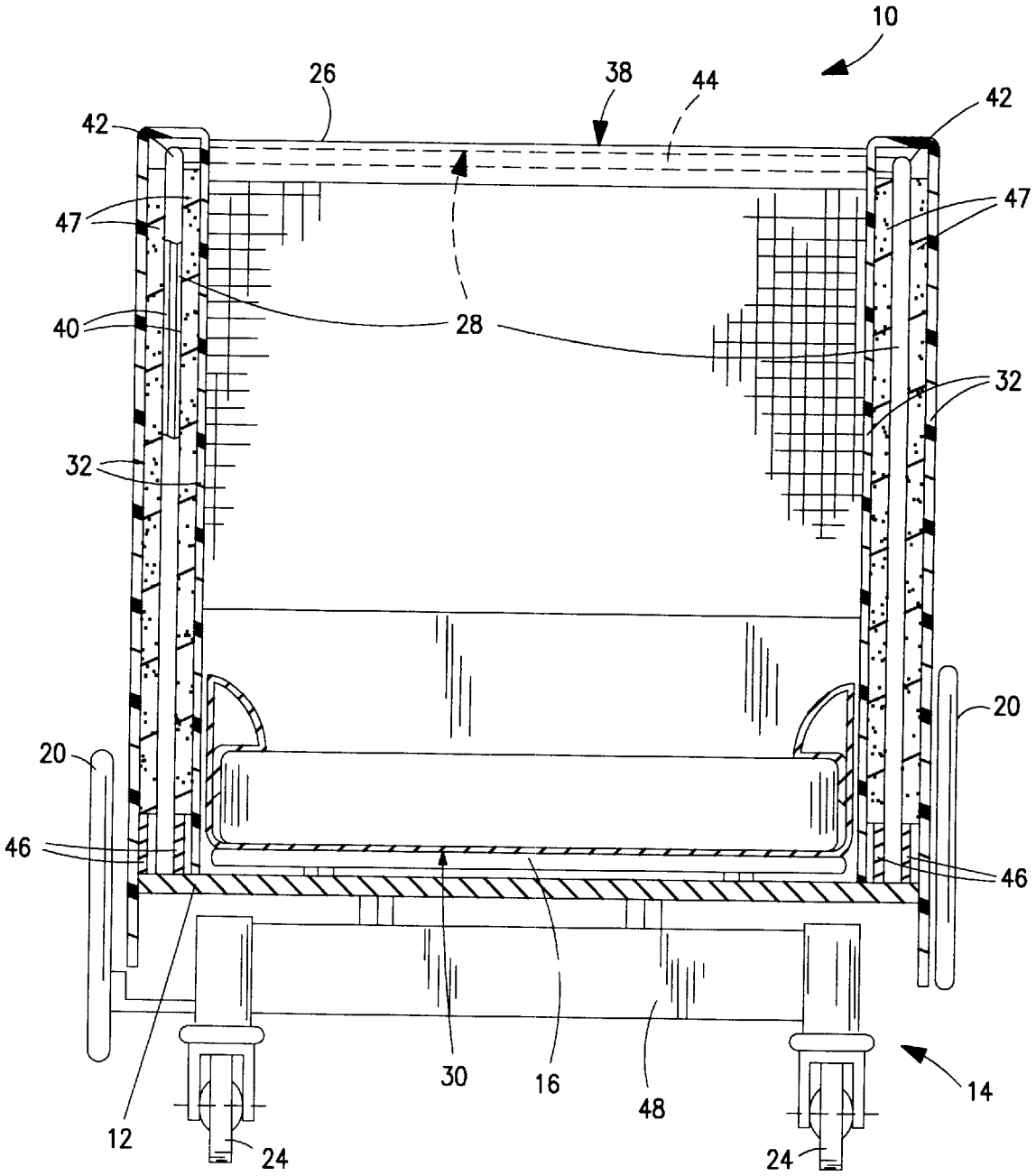
FIG. 9 is a side elevation sketch view of a bed and a bed enclosure with the intermediate frame of the bed raised.

Upright durable segment 64 includes an I.V. slot 80 through which an I.V. tube 82 can be inserted without the need for removal of the I.V. from the patient. An insert 79 formed to include an internal slot 81 is received in a slot 83 in upright durable segment to provide rigidity to I.V. slot 80 as shown, for example, in FIG. 7. One mechanism allowing insertion of I.V. tube 82 into I.V. slot 80 is shown in FIG. 8. Rod 74 is formed of aligned upper rod 84 and lower rod 86 separated by a gap 88 adjacent to I.V. slot opening 90. A spring loaded latch 92 is received in lower rod 86 and normally extends into a recess 94 in upper rod 84 thereby filling gap 88. Latch 92 includes an actuator 96 extending externally from lower rod 86. Handle 72 of mesh curtain 58 has a height 98 greater than width 100 of gap 88. During lowering of mesh curtain 58, handle 72 rides down upper rod 84 until bottom of handle 72 crosses gap 88 at which time handle 72 momentarily rides along both upper and lower rods 84, 86 and after further lowering rides solely on lower rod 86. As handle 72 approaches the lower-most position in its range of travel, handle 72 engages actuator 96 and retracts spring loaded latch 92 from recess 94 in bottom of upper rod 84. An I.V. tube 82 may then be inserted through gap 88 and I.V. slot opening 90 into I.V. slot 80. Upon raising mesh curtain 58, handle 72 disengages actuator 96 allowing spring loaded latch 92 to move in direction of arrow 97 in FIG. 8 to again extend across gap 88 to secure I.V. tube 82 received in I.V. slot 80 within slot 80.

Figure 6:
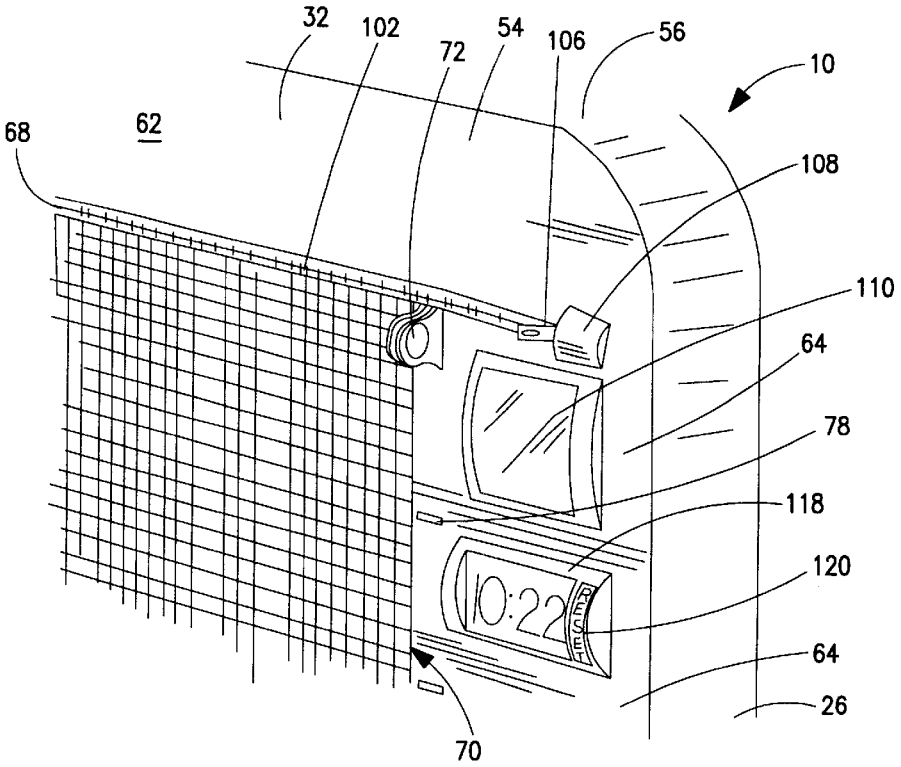
FIG. 6 is a perspective view of a portion of the bed enclosure of FIG. 1 showing a contact attached to the bed enclosure which is engaged by the slide of the top zipper on the side curtain to activate an indicator light for indicating the state of the zipper, and a resettable digital display which may indicate the time since a patient was last checked or medicated.

A zipper 102 is provided across top 68 of mesh curtain 58 and bottom 104 of sidewall portion 62 of durable segment 54 to secure mesh curtain 58 to sidewall portion 62 of durable segment 54 when mesh curtain 58 is in the fully raised state, as shown in FIGS. 1, 3, and 6. As shown in FIG. 6, when zipper 102 is fully closed so that patient is confined to the bed surface, pull or slide 106 of zipper 102 engages a contact 108 which activates and deactivates a security light 110. In the illustrated embodiment light 110 is illuminated when zipper pull 106 is not in contact with contact 108 and is extinguished when zipper pull 106 is in contact with contact 108. While security light 110 is illustratively activated by pull 106 and contact 108, it should be understood that contact 108 may be replaced with a limit switch, optical sensor, proximity sensor, magnetic sensor or other sensor or device configured to send an activation signal to light 110 when zipper is not fully closed. While not shown in the drawings, bed enclosure 10 includes two security lights 110, side curtains 58, and zippers 102, one each on each side wall 32, and a system is provided which illuminates both lights 110 when either zipper 102 is not fully closed. Security light 110 provides care takers with a visible reference by which they can insure that bed enclosure 10 is fully closed when a patient's condition requires full restraint.

Side walls 32 also include a zipper 112 forming an access port 114 in mesh curtain 58 running along the length of bed enclosure 10 enabling the care giver to quickly access the patient for normal care activities while providing the care giver more protection from patient's inadvertent movements. The zippered access port 114 is shaped as a half oval to allow port 114 to be quickly and easily opened and closed. As is shown, for example, in FIGS. 3–6 and 8–9 a clear plastic flexible shield 116 over the beginning of zipper 112 ensures that the patient cannot open this port 114.

Patients whose conditions require restraint often require periodic observation. Bed enclosure 10 includes a resettable observation timer 118, as shown in FIG. 6 which can be reset to zero by pressing reset button 120 after every observation so caregivers can keep track of observations of the patient. In the illustrated embodiment, resettable observation timer 118 is a digital indicator with a large number readout indicating minutes and seconds elapsed since it was last reset so that care takers passing the patient's room can easily determine the last time that the patient was observed. In preferred embodiments a timer 118 is provided on each side of the bed enclosure. Pushing one resets both. Resettable timer 118 can also be used to determine the interval between medications and other treatments.

Hospital beds 14 are typically provided with side rails 20 which may be raised or lowered as needed. Side rails 20 include switches or controls 122 for controlling articulating deck 16 to allow the patient to reconfigure bed 14 for greater comfort, and also often contain controls 122 for in-room T.V.s and lighting as well as caregiver call buttons. Thus when the patient is in bed 14 side rails 20 are typically in the raised position to provide the patient access to controls 122 in side rail 20. Typically side rails 20 are lowered during patient transfer between bed 14 and another surface. Bed enclosure 10 is configured so that side rails 20 are on the exterior of bed enclosure 10 so that bed enclosure 10 does not inhibit raising and lowering of side rails 20.

Side rails 20 are typically attached to articulating deck 16 of bed 14 so that controls 122 located on side rail 20 are accessible to the patient even when bed 14 is in an inclined position, as shown, for example, in FIG. 3. In FIG. 3 the far side rail 20 is in the raised position while the near side rail 20 is in the lowered position. Near head end 124 of side wall 32 additional material 125 is provided to accommodate raising and lowering of side rail 20. Also, additional material 126 formed into a bellows or the like is provided near head end 128 of bottom panel 30 at the point of connection of bottom panel 30 to side wall 32 to facilitate articulation of articulating deck 16 through its full range of motion. Prior bed enclosures such as the Vail 3000 bed enclosure described in U.S. Pat. No. 5,384,925 limited deck articulation because the bottom panel was rigidly coupled to the side wall. Bellows 126 and additional material 125 in side wall 32 allow articulation of articulating deck 16 through its fall range of motion.

In illustrated bed enclosure 10 not only is full head section articulation permitted, but other functions of bed 14 are facilitated because skeletal structure 28 is attached directly to intermediate frame 12 eliminating the need for a free standing bed enclosure base. Attaching bed enclosure 10 to intermediate frame 12 facilitates full use of the hi-lo functions of bed 14 as shown by arrows 144 in FIG. 9 since bed enclosure 10 moves vertically as intermediate frame 12 moves vertically. Attachment of bed enclosure 10 to intermediate frame 12 also allows bed 14 to be rolled on wheels or casters 24 with bed enclosure 10 attached as shown by arrows 146 in FIG. 9 since bed enclosure 10 moves horizontally as intermediate frame 12 moves horizontally. Eliminating the base also ensures use of existing lifts, scales, and overbed tables with bed 14 equipped with bed enclosure 10.

Although illustrated bed enclosure 10 mounts to the intermediate frame 12 of bed 14 by inserting the lower portion of supports 40 in sockets 46, it is within the scope of the invention to attach enclosure to the frame of a bed with clamps, straps, brackets, and the like. Enclosure can also be attached to the frame of a bed that does not include a height adjustable intermediate frame or an articulating deck if those features are not required for treatment of a patient whose movements need to be restricted to the bed.

Foot end wall 36 includes an end wall portion 130 of clear segment 52 and a mesh segment 132 which are R.F. welded, or otherwise joined, to each other and to upright durable segment 64. Patient T.V. viewing is improved by replacing mesh with plastic at the foot end of roof 38 and at upper end of foot end wall 36, as shown for example in FIGS. 1–3.

Head end wall 34 includes a mesh segment 134 which is R.F. welded, or otherwise attached, to mesh segment 50 of roof 38 and durable upright segment 64 of side walls 32. Bottom panel 30 is typically formed of vinyl, polyester or other durable material which is R.F. welded, or otherwise attached, around the perimeter of the material to the bottom of side walls 32, head end wall 34, and foot end wall 36.

Bed enclosure 10 also includes mattress side cushions 136 which aid in maintaining a patient closer to the center of mattress 18. Illustrated side cushions 136 are fabric covered foam material and are configured with indentations 138 adjacent to the position of controls 122 on a raised side rail 20, as shown, for example, in FIG. 8, to allow the patient to access controls 122. FIG. 8 also illustrates that the mesh material used to form mesh curtain 58 has a large enough weave so that a patient's fingers can pass through the weave to operate controls 122 on side rail 20.

Figure 10:
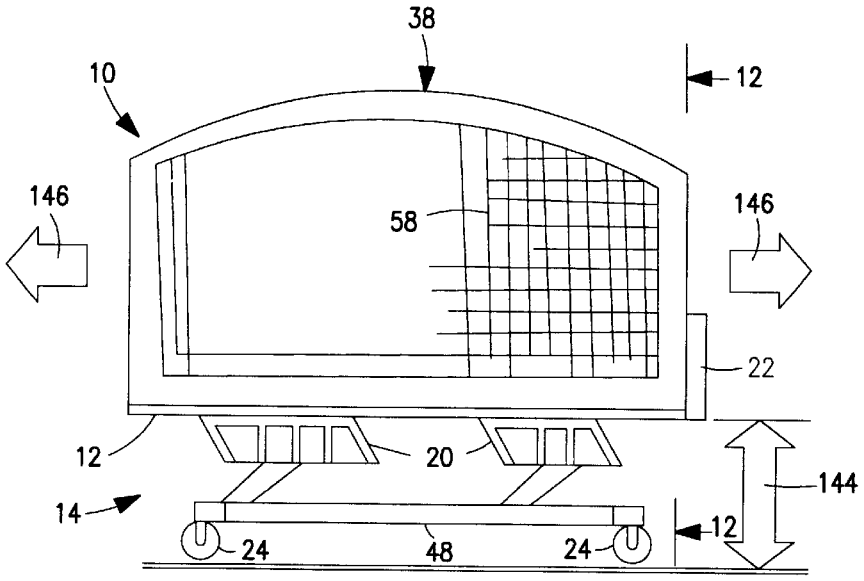
FIG. 10 is a cross-sectional view of the bed enclosure of FIG. 1 taken along line 10—10 of FIG. 9.

Foam pads 136 are enclosed in material 140 which includes a flap 142 which is connected to bottom panel 30 of bed enclosure 10 as shown, for example, in FIG. 10. Foam pads 136 are placed around the inside edges of bed enclosure 10, and lie on the surface of mattress 18, to ensures that patient movement against side rails 20 will not cause injury. Flap 142 on material 140 surrounding foam pad 136 allows foam pad 136 to act as if it is hinged, permitting foam pad 136 to be flipped to the outside of bed 14 when side rail 20 and mesh curtain 58 are lowered, as shown, for example, in FIG. 4. This allows the use of existing sheets and does not impede the patient's bedside activities.

An alternative embodiment of bed enclosure 210 is shown in FIG. 11. Bed enclosure 210 is substantially similar to bed enclosure 10 so like reference numerals are employed to describe like parts. Bed enclosure 210 substantially differs from bed enclosure 10 in the location of observation timer 318, I.V. slot 280 and I.V. slot opening 290 and the mechanism for raising and lowering mesh curtain 258. Sides 270 of mesh curtain 258 ride in slots (not shown) formed in rods 274. As a result of this configuration, it is necessary to position I.V. slot 280 and I.V. slot opening 290 near the top of the range of travel of mesh curtain 258. Some beds provide controls 322 for bed operation and other controls 322 on a hand held pendant 348 instead of on the side rail 20. For beds having hand held pendants 348 a mesh pouch 350 is provided as shown, for example, in FIG. 12.

Figure 13:
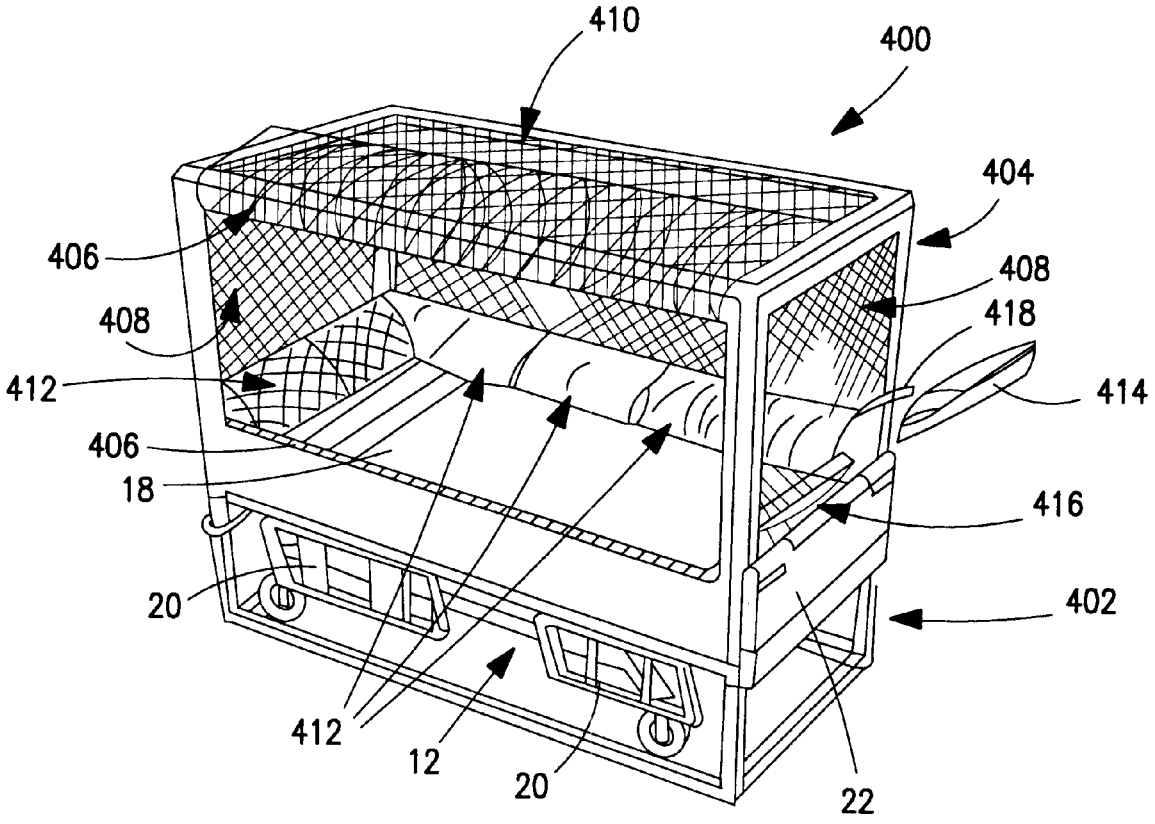
FIGS. 13–36 show various additional alternative bed enclosure embodiments and alternative bed enclosure features.

An alternative embodiment bed enclosure 400 includes a frame or skeletal structure 402 and an enclosing shell 404 as shown in FIG. 13. Although illustrative frame 402 includes portions that rest upon the floor, it is within the scope of the disclosure for frame 402 to be mounted to intermediate frame 14 of bed 12 as was the case with bed enclosure 10. Shell 404 includes a bottom panel (not shown) beneath mattress 18 of bed 12, sidewalls 406, end walls 408, and top wall or roof 410. Each of walls 406, 408, 410 are made predominantly of a mesh material, but walls 406, 408, 410 also include perimeter portions that are made from vinyl, plastic or other suitable material to which the mesh material couples. The perimeter portions of walls 406, 408, 410 are provided with passages that receive respective frame members of frame 402. In addition, the mesh material of at least one of walls 406, 408, 410 is fashioned as a flap that is openable and closable, such as by a zipper, relative to the surrounding perimeter portion as shown in FIG. 13 with respect to one of sidewalls 406.

Bed enclosure 400 includes a plurality of pouches 412 that are coupled to sidewalls 406 and end walls 408 as shown in FIG. 13. Pouches 412 extend inwardly from walls 406, 408 and are sized to receive pillows 414. In preferred embodiments, pouches 412 are sized to receive standard-size pillows. Walls 406, 408 each include slots 416 that permit pillows 414 to be inserted into and removed from pouches 414. For example, in FIG. 13, a pillow 414 at the foot end of bed 12 is arranged for insertion through the associated slot 416 in the direction of the double arrow 418. Optionally, zippers (not shown) are included in walls 406, 408 adjacent slots 416 so that slots 416 are openable and closable.

Illustratively, pouches 412 are made from the same mesh material as the respective portions of walls 406, 408. However, it is within the scope of the disclosure for pouches 412 to be made of any material having suitable strength and flexibility. Insertion of pillows 414 into pouches 412 provides a padded barrier between the patient and both the siderails 20 and end boards 22 of bed 12. In preferred embodiments, pouches 412 are fabricated such that pillows 414 are held in an orientation that is more vertical than horizontal, thereby minimizing the amount of area around the perimeter of mattress 18 that is covered by pillows 414.

Figure 14:
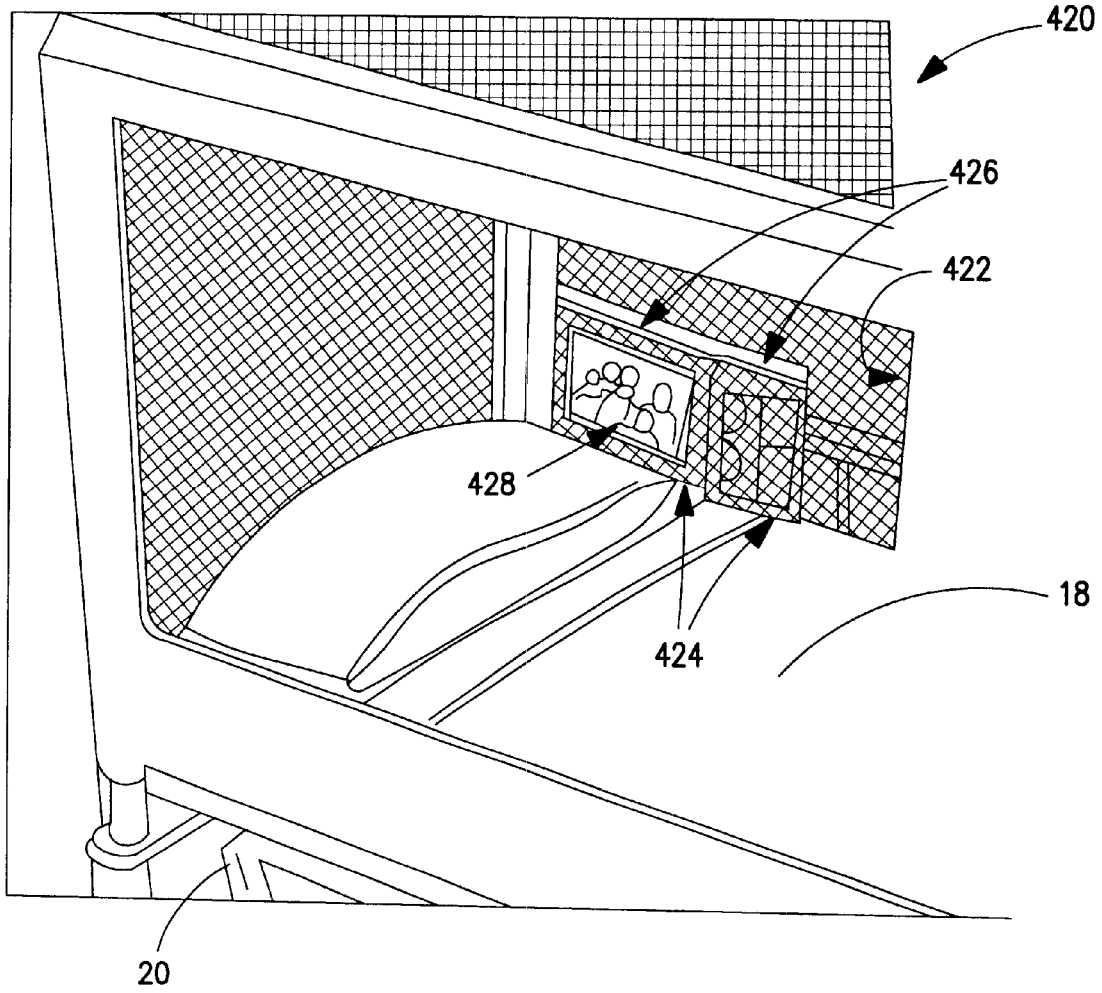

An alternative bed enclosure 420, shown in FIG. 14, includes a sidewall 422 having coupled thereto a pair of pockets 424. Pockets 424 each include a top opening 426. Top openings 426 optionally may be openable and closable, such as by a zipper, or pockets 424 may include a normally-contracted, extensible band or cord adjacent respective top openings 426. Pockets 424 are sized for receiving a few small personal items of the patient, such as eyeglasses, a remote control, a wallet, or one or more photos. Illustratively, a transparent sleeve 428 is coupled to one of pockets 424. Sleeve 428 includes an opening, either at its top or its side, which permits a photograph to be inserted into and retained by sleeve 428. Although bed enclosure 420 illustratively includes two pockets 424 coupled to sidewall 422, it is within the scope of the disclosure for a different number of pockets 424 to be included in bed enclosure 420 and for pockets 424 to be coupled to portions of bed enclosure 420 other than sidewall 422.

Figure 15:
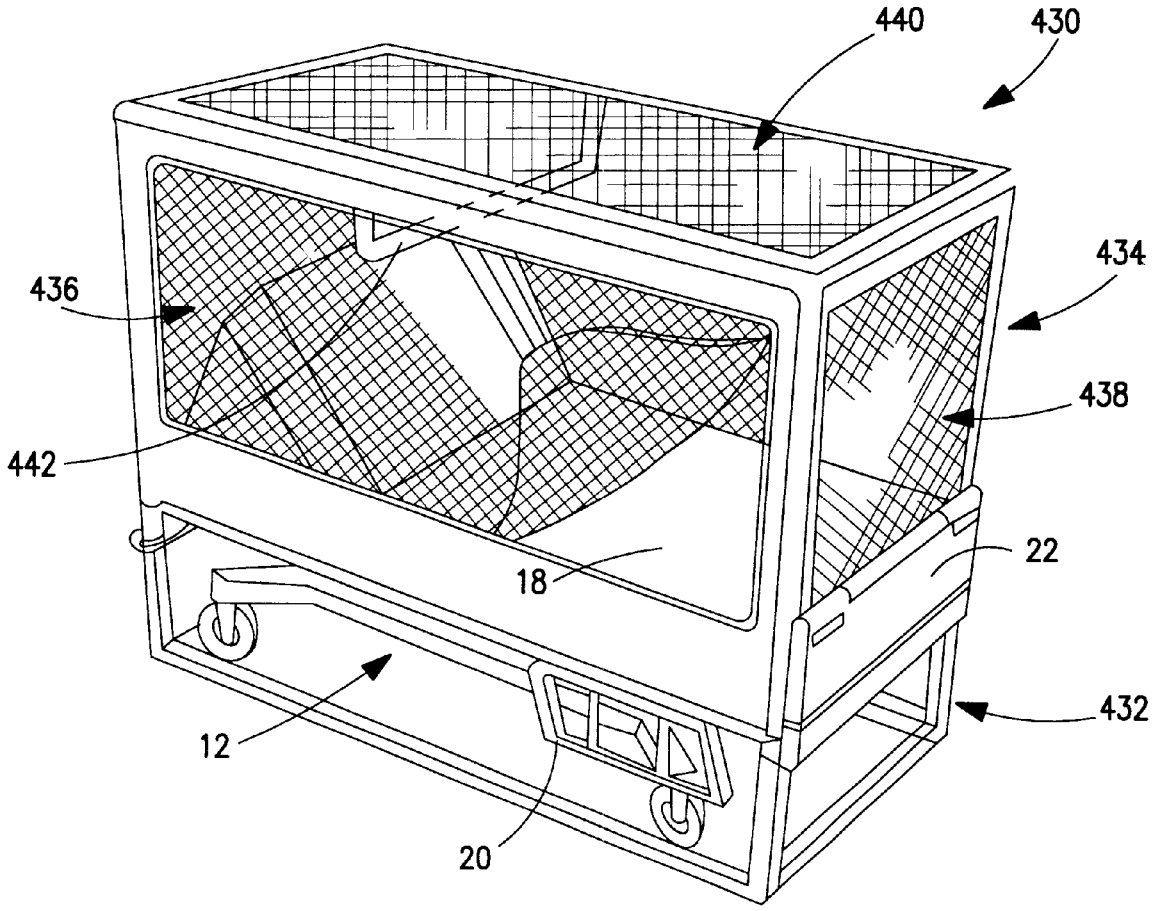

An alternative embodiment bed enclosure 430 includes a frame or skeletal structure 432 and an enclosing shell 434 as shown in FIG. 15. Although illustrative frame 432 includes portions that rest upon the floor, it is within the scope of the disclosure for frame 432 to be mounted to intermediate frame 14 of bed 12 as was the case with bed enclosure 10. Shell 434 includes a bottom panel (not shown) beneath mattress 18 of bed 12, sidewalls 436, end walls 438, and top wall or roof 440. Each of walls 436, 438, 440 are made predominantly of a mesh material, but walls 436, 438, 440 also include perimeter portions that are made from vinyl, plastic or other suitable material to which the mesh material couples. The perimeter portions of walls 436, 438, 440 are provided with passages that receive respective frame members of frame 432. In addition, the mesh material of at least one of walls 436, 438, 440 is fashioned as a flap that is openable and closable, such as by a zipper, relative to the surrounding perimeter portion as shown in FIG. 15 with respect to one of sidewalls 436.

Bed enclosure 430 includes a repositioning bar 442 coupled to top frame members of frame 432 and extending transversely therebetween as shown in FIG. 15. Bar 442 is generally U-shaped and hangs downwardly from the top frame members of frame 432 at a location that facilitates patient repositioning. That is, a patient resting on mattress 18 of bed 12 grips a central, transverse portion of bar 442 to reposition himself or herself. Such repositioning may be necessary or desired, for example, when a head section of bed 12 is moved to a raised position because patients have a tendency to slide and migrate inadvertently toward the foot of beds as a result of such bed adjustments.

Those skilled in the art will appreciate that bar 442 may include a variety of coupling mechanisms at the ends thereof which are configured to permit selective attachment to and detachment from the top frame members of frame 432. Such coupling mechanisms may include hooks, latches, or other suitable gripping members that permit bar 442 to be coupled to the top frame members either at a predetermined location or anywhere along the lengths thereof. In addition, those skilled in the art will appreciate that it is within the scope of the disclosure for other patient-positioning equipment, such as trapeze bars, traction cables, pulleys, of stirrups, to be coupled to bar 442.

Figure 16:
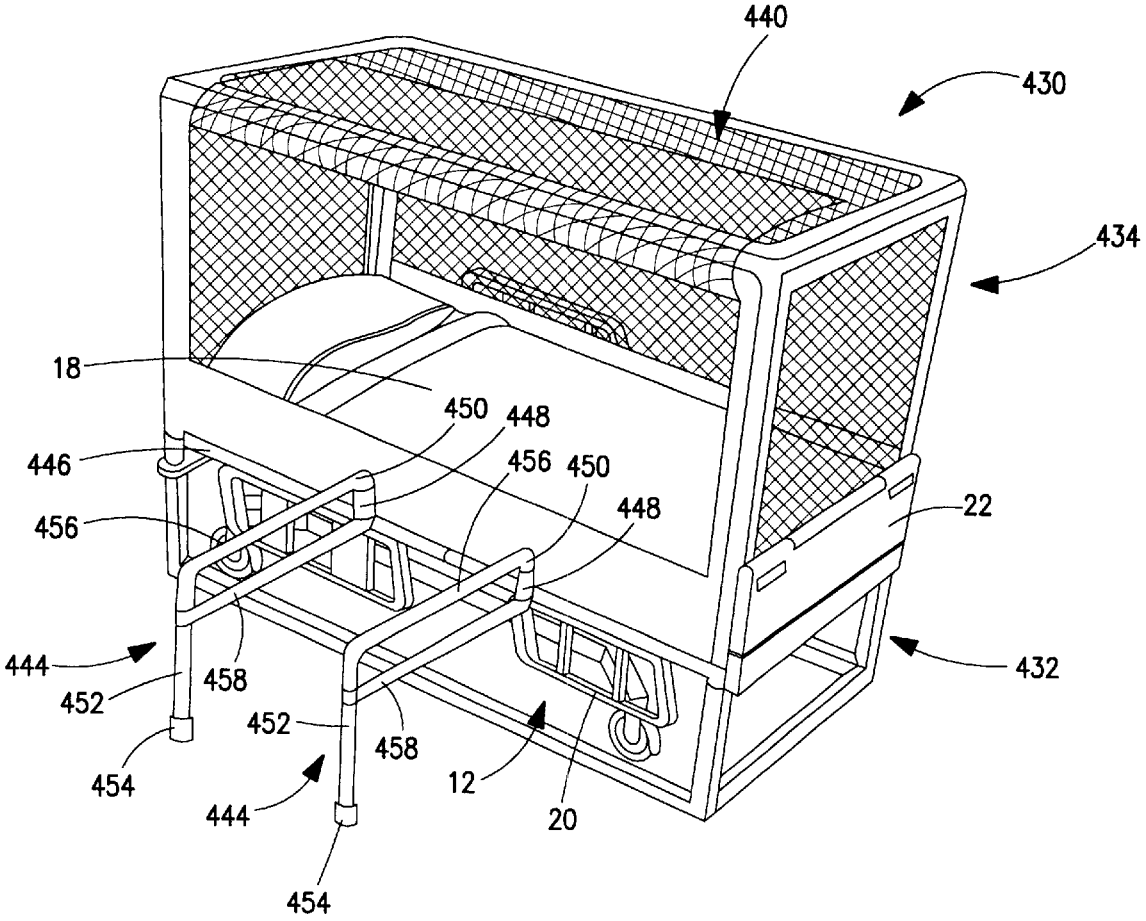

Another alternative embodiment bed enclosure, similar to bed enclosure 430, is shown in FIG. 16. Because of the similarities between the bed enclosure of FIG. 16 and bed enclosure 430 of FIG. 15, like reference numerals are used to denote like components. Bed enclosure 430 of FIG. 16 includes a pair of patient assist rails 444 that are coupled to frame 432. Frame 432 includes a longitudinal frame member 446 positioned adjacent mattress 18 of bed 12 and bed enclosure 420 includes a pair of collars 448 that mount to frame member 446.

Patient assist rails 444 include vertical portions 450 coupled to collars 448, vertical portions 452 having floor-engaging lower ends covered by caps 454, a horizontal upper portion 456 extending between vertical portions 450, 452, and a horizontal lower portion 458 extending between vertical portions 450, 452 beneath upper portion 456 in parallel relation therewith. In preferred embodiments, portions 450, 452, 456, 458 of each rail 444 are formed integrally and are bent into shape out of a unitary tubular element.

Rails 444 extend transversely away from bed 12 and are configured to be gripped by a patient entering and exiting bed 12. Illustrative rails 444 are fixed rigidly to collars 448 so as to be maintained at all times in their transversely extending positions. However, it is within the scope of the disclosure for rails 444 to pivot relative to collars 448 into longitudinally extending positions adjacent to the side of bed 12. In such an embodiment where rails 444 pivot, locking devices are provided to lock rails 444 relative to collars 448.

Figure 17:
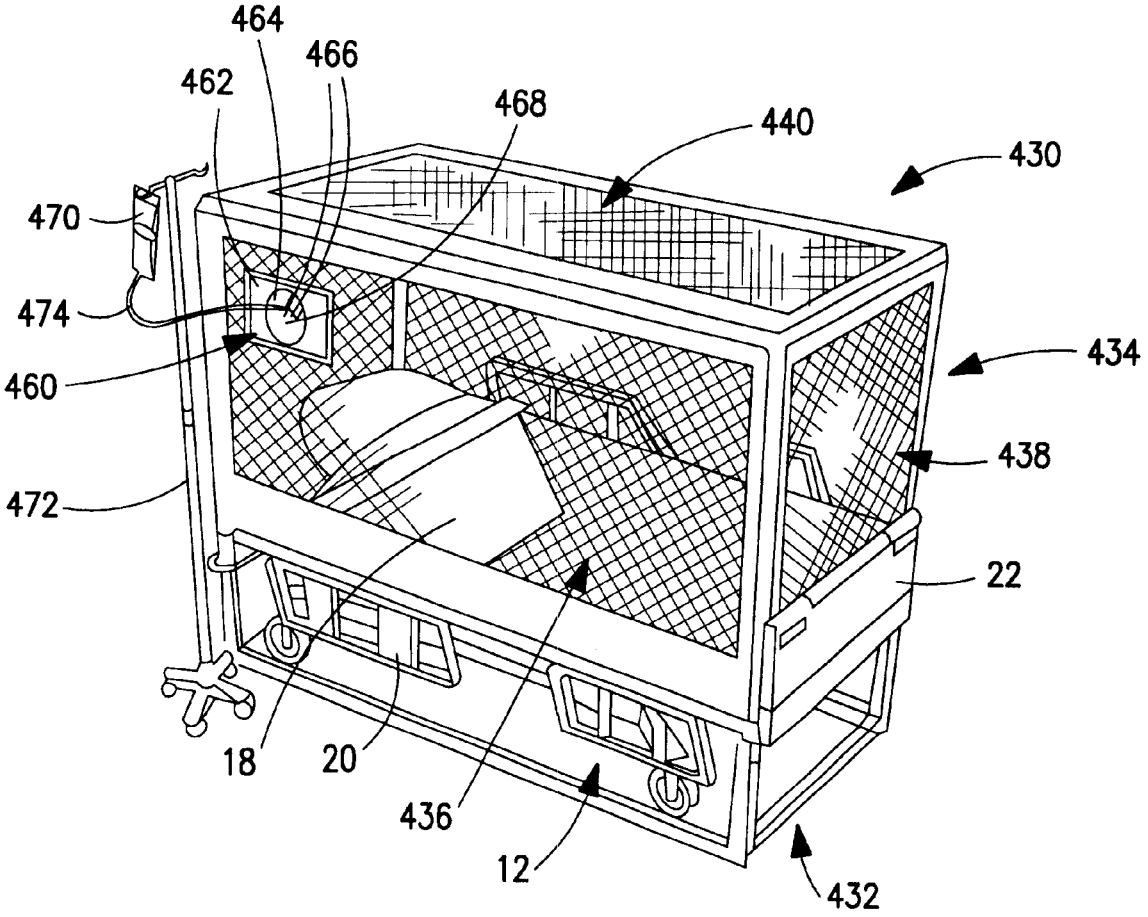

Another alternative embodiment bed enclosure, similar to bed enclosure 430, is shown in FIG. 17. Because of the similarities between the bed enclosure of FIG. 17 and bed enclosure 430 of FIG. 15, like reference numerals are used to denote like components. Bed enclosure 430 of FIG. 17 includes an IV port 460 coupled to a mesh portion of one of sidewalls 436. IV port 460 includes a main panel 462 having a large aperture 464 formed therein. IV port 460 further includes a plurality of plates or members 466 that are coupled to main panel 462 for movement within aperture 464 to adjust the size of an opening defined between members 466 in a central region of aperture 464. IV port 460 includes one or more handles 468 that are coupled to members 466 and that move about aperture 464 to control the movement of members 466. Main panel 462 provides a barrier so that a patient restrained by bed enclosure 430 cannot access handles 468.

IV port 460 is configured so that when members 466 are moved to a wide open position, such that the opening defined between members 466 is approximately the size of aperture 464, a bag or bottle 470 containing an IV solution is able to pass through aperture 464 and hook to a conventional IV pole 472 as shown in FIG. 17. Thereafter, handle 468 is manipulated so that members 466 move to close the opening around an IV line 474 that is routed from bag 470, through IV port 460, and to the patient supported by bed 12. Thus, IV port permits a patient to get into and out of bed 12 without having to disconnect IV line 474 from the patient.

Figure 18:
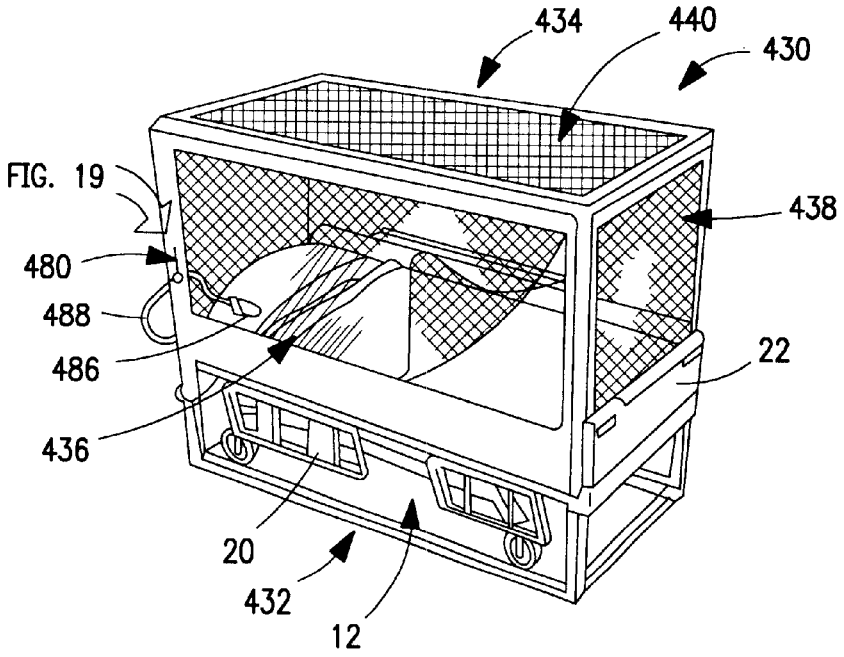

Another alternative embodiment bed enclosure, which is also similar to bed enclosure 430, is shown in FIG. 18. Because of the similarities between the bed enclosure of FIG. 18 and bed enclosure 430 of FIG. 15, like reference numerals are used to denote like components. Bed enclosure 430 of FIG. 18 includes a port 480 formed in the perimeter portion of one of sidewalls 436 adjacent the head end of bed enclosure 430. Illustratively, port 480 is formed as a vertical slot and is openable and closable by a zipper 482 having zipper halves 484 coupled to sidewall 436 at the opposite vertical edges of port 480 as shown in FIG. 19.

Port 480 permits objects to be passed into and out of the interior region of bed enclosure 430 without having to open the large mesh flap portion of sidewall 436. Illustratively, a pendant controller 486 has been passed through port 480 and a cable 488 that couples pendant controller 486 to the main control circuitry of bed 12 extends from pendant controller 486 through port 480. Pendant controller 486 is of the conventional type and may include various user inputs well-known to those skilled in the art. Such user inputs may include buttons, knobs, or switches that control movement of portions of bed 12, that send a nurse-call signal, that control room lighting, and that control a television.

Figure 19:
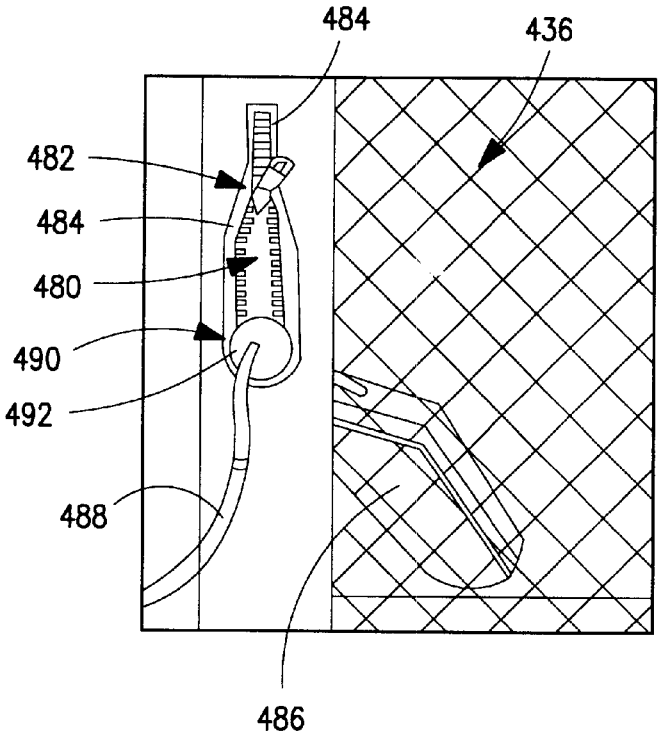

In the illustrated embodiment, a grommet 490 is fastened to cable 488 and is received in port 480 at the bottom end thereof as shown best in FIG. 19. Grommet 490 includes flanges 492 (only one of which can be seen in FIG. 19) and a connecting portion (not shown) between flanges 492. The connecting portion is smaller than flanges 492 and holds flanges 492 in spaced-apart, parallel relation. When zipper 482 is closed against grommet 490, portions of zipper halves 484 move into the space between flanges 492 to hold grommet 490 firmly in port 480 relative to sidewall 436. Grommet 490, therefore, limits the amount of cable 488 that is positioned in the interior region of bed enclosure 430 thereby enhancing patient safety. It will be appreciated that IV bags or bottles, as well as other objects, may pass through port 480 and that grommet 490 may be used to limit the amount of IV line that is positioned in the interior region of bed enclosure 430.

Figure 20:
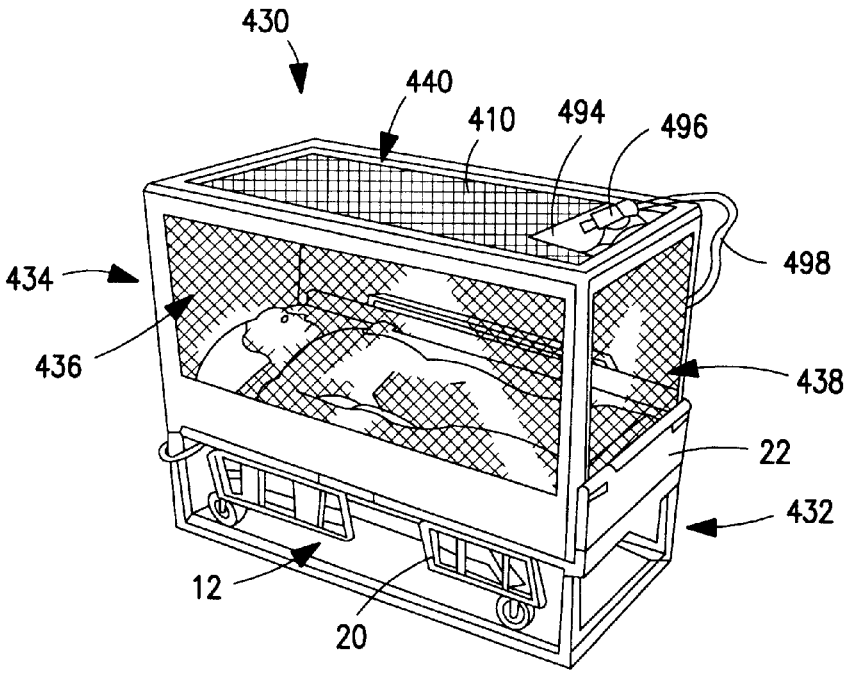

Another alternative embodiment bed enclosure, similar to bed enclosure 430, is shown in FIG. 20. Because of the similarities between the bed enclosure of FIG. 20 and bed enclosure 430 of FIG. 15, like reference numerals are used to denote like components. The top wall 410 of bed enclosure 430 of FIG. 20 includes a transparent window 494 adjacent the foot end of bed enclosure 430. In addition, bed enclosure 430 includes a video camera 496 mounted to an upper transverse frame member of frame 432 by suitable mounting devices (not shown) well known to those skilled in the art.

Figure 21:
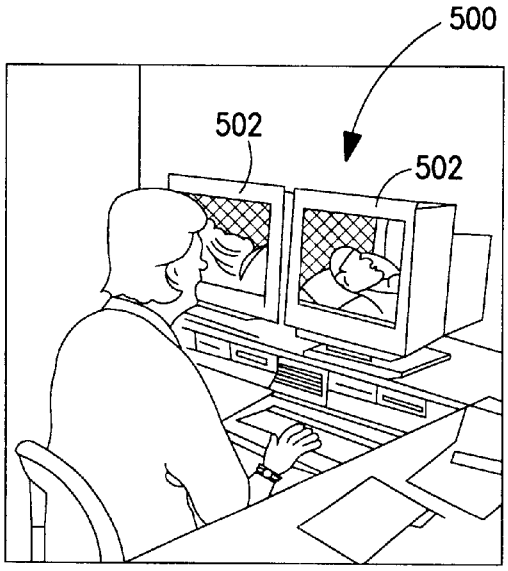

Camera 496 is aimed at the patient through transparent window 494, as shown in FIG. 20, and sends a video signal over video line 498 to a caregiver station 500 where a caregiver monitors the activity of the patient on a video monitor 502, as shown in FIG. 21. In preferred embodiments, camera 496 includes a microphone and speaker so that audio signals are transmittable between the patient restrained in bed enclosure 430 and the caregiver located at caregiver station 500. Illustratively, two video monitors 502 are located at caregiver station 500 so that two patients are being monitored by the caregiver simultaneously. However, a different number of video monitors 502 may be included at caregiver station 500, if desired.

Caregiver station 500 preferably includes equipment permitting the caregiver to control which video signal, among a plurality of video signals, is shown on each monitor 502. In a default mode, each monitor 502 displays video signals from a plurality of cameras 496 sequentially such that each video signal is displayed for a predetermined period of time and then the next video signal in the sequence is displayed. Optionally, a number of video signals are displayed at the same time on monitors 502. In addition, it is within the scope of this disclosure to include equipment at caregiver station 500 that records the video signals from cameras 496 for each patient restrained by bed enclosure 430 to provide a permanent record of the patient's activities while restrained in bed enclosure 430 and to record care provided to the patient while so restrained.

Figure 22:
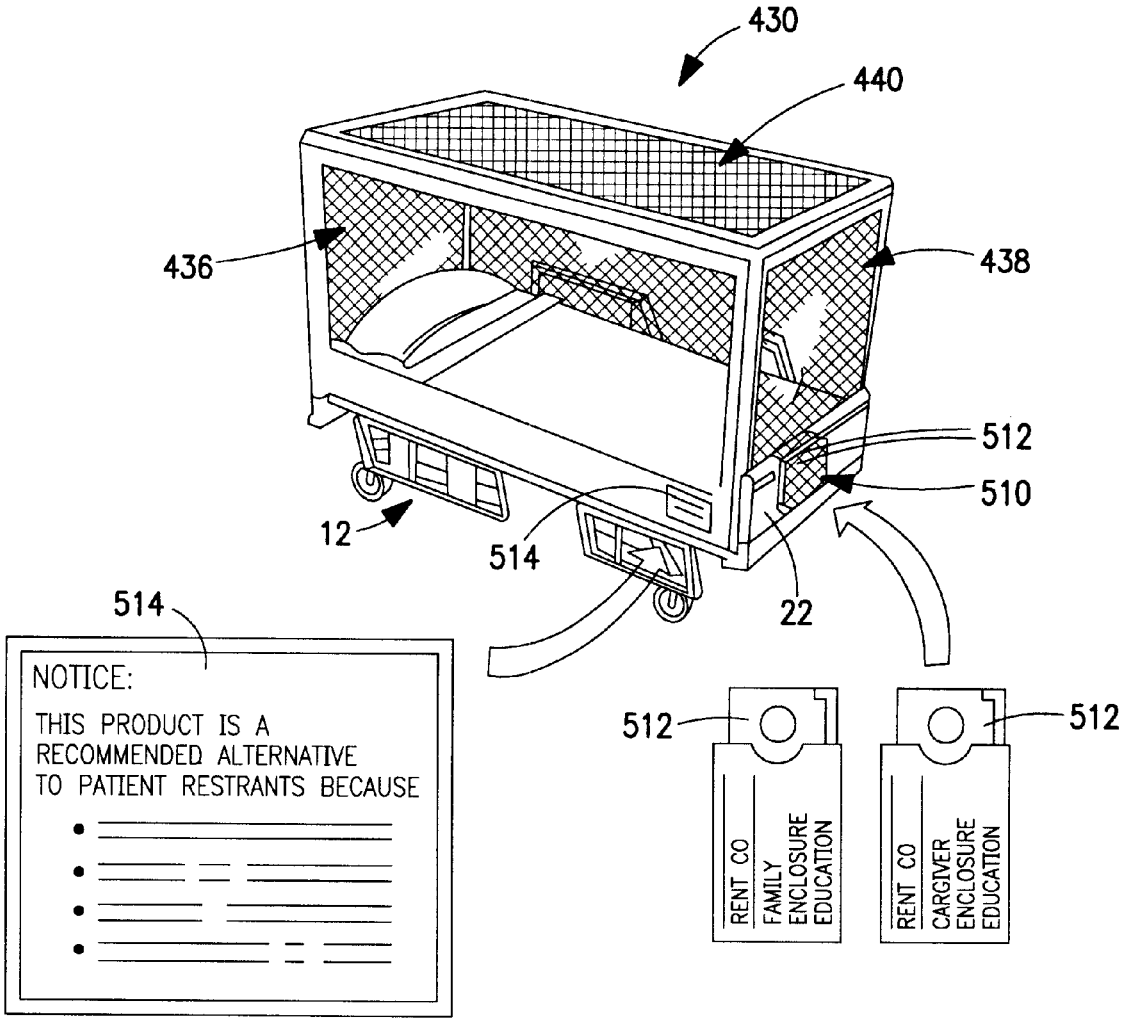

The bed enclosure of FIG. 22 is similar to bed enclosure 430 of FIG. 15 and therefore, like reference numerals are used to denote like components. Bed enclosure 430 of FIG. 22 includes a pouch 510 coupled to one of end walls 438 adjacent the foot end of bed enclosure 430. Pouch 510 hangs downwardly from end wall 438 and drapes over end board 22. Pouch 510 includes a top opening (not shown) and is preferably sized and configured to receive one or more videocassettes 512 as shown diagrammatically in FIG. 22, although other objects may be stored in pouch 510 if desired.

A patient and a patient's family and friends may not understand either the reasons for restraining a patient in bed enclosure 430 or the other more restrictive alternatives of patient restraint that are used by caregivers in lieu of bed enclosure 430. Therefore, videocassettes 512 are provided for the benefit of the patient and those visiting the patient to explain the features and advantages of bed enclosure 430. In addition, a notice label is attached to the non-mesh, perimeter portion of sidewall 436 of bed enclosure 430, as shown diagrammatically in FIG. 22, to provide an immediate and visible notification to those visiting the patient as to the features and advantages of bed enclosure 430.

Figure 23:
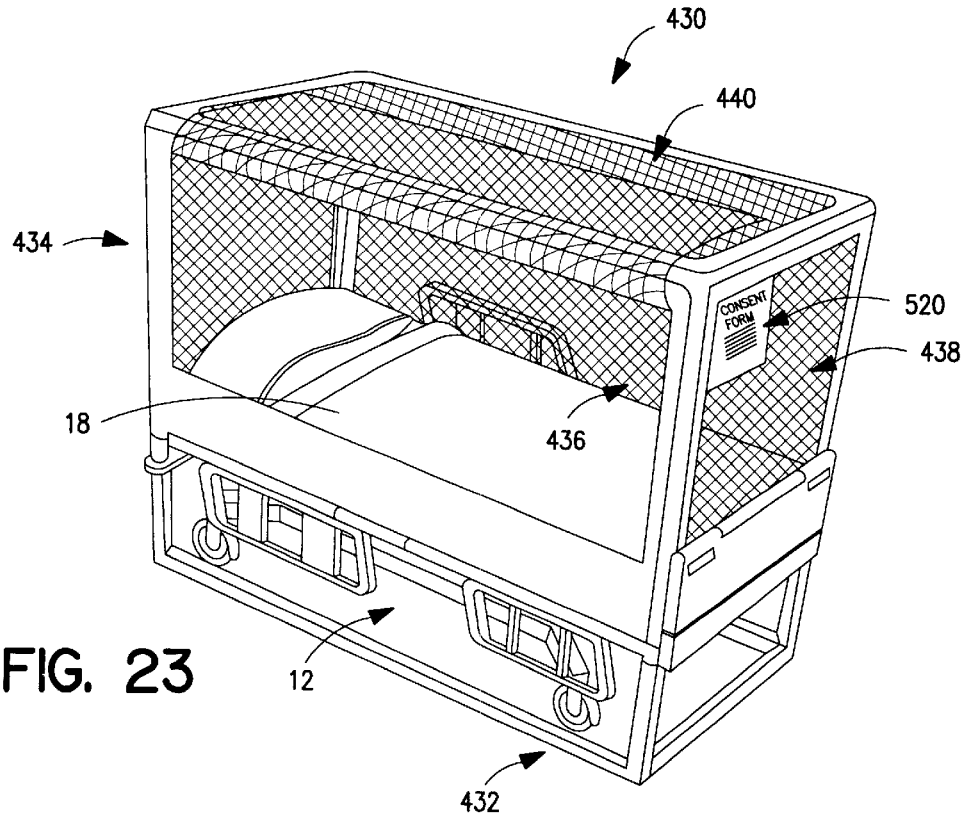

The bed enclosure of FIG. 23 is similar to bed enclosure 430 of FIG. 15 and therefore, like reference numerals are used to denote like components. Bed enclosure 430 of FIG. 23 includes a pocket 520 coupled to end wall 438. Pocket 520 is preferably made of a transparent material and is open at its top. Pocket 520 is sized and configured to receive a document, such as a consent form as shown in FIG. 23. The consent form is signed either by the patient or the patient's legal representative to show consent regarding the use of bed enclosure 430 in connection with the treatment of the patient. Displaying the consent form in pocket 520 provides an immediate and visible notice to visitors that the patient, or the patient's legal representative, has consented to the use of bed enclosure 430 to restrain the patient. Other documents, such as medical records or patient data, may be stored in pocket 520 as well.

Figure 24:
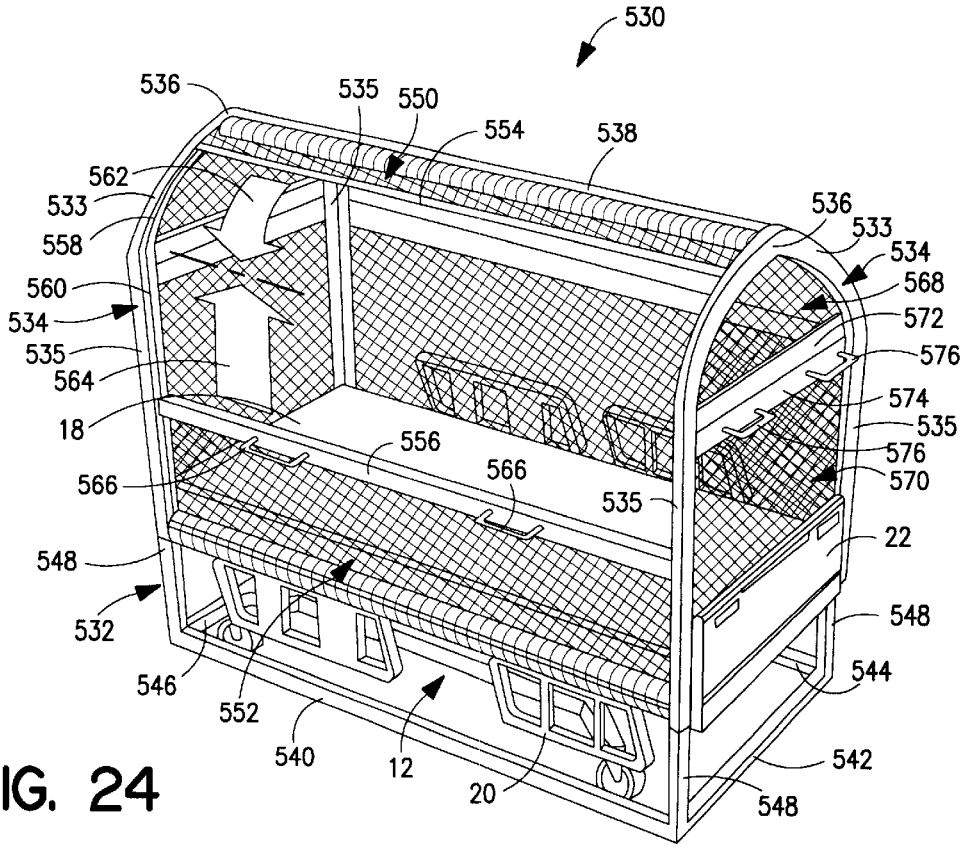

An alternative bed enclosure 530 includes a frame 532 having a pair of end frame members 534, each of which has an arched top portion 533 and straight vertical portions 535 extending downwardly from the respective arched top portion as shown in FIG. 24. Arched top portions 533 each include an apex 536 and frame 532 includes a longitudinal frame member 538 extending between apexes 536. Frame 532 further includes first, second, third, and fourth floor-engaging members 540, 542, 544, 546 forming a rectangle and four posts 548 extending upwardly at the corners of the rectangle formed by members 540, 542, 544, 546. Posts 548 couple to respective a straight portions 535 of end frame members 534. It is within the scope of the disclosure for frame 532 not to include members 540, 542, 544, 546 and posts 548, such that end frame members 534 couple to an intermediate frame of bed 12 to raise and lower therewith.

Bed enclosure 530 includes a pair of upper sidewall portions 550 and a pair of lower sidewall portions 552 as shown in FIG. 24. Each upper sidewall portion 550 includes a quantity of mesh material and a longitudinal rail 554 coupled to a lower, longitudinal edge of the associated mesh material. Similarly, each lower sidewall portion 552 includes a quantity of mesh material and a longitudinal rail 556 coupled to an upper, longitudinal edge of the associated mesh material. The ends of each rail 552 along with the end edges of the associated mesh material are received in respective slots 558 formed in the arched top portions 533 of frame members 534 and the ends of each rail 554 along with the end edges of the associated mesh material are received in respective slots 560 formed in the straight portions 535 of frame members 534.

Bed enclosure 530 further includes a pair of upper rollers (not shown) on which respective upper sidewall portions 550 wind/unwind and a pair of lower rollers (not shown) on which respective lower sidewall portions 552 wind/unwind. The upper and lower rollers each include components that spring bias the rollers to rotate in the direction having the respective sidewall portions 550, 552 wound thereon. Thus, sidewall portions 550, 552 are "roll-up" sidewall portions.

Suitable locking mechanism, such as pins, hooks, clutches, or latches, are provided at the ends of rails 554, 556 and engage frame members 532 to lock rails 554, 556 in desired positions. Release levers or buttons (not shown) are coupled to corresponding locking mechanisms and are accessible to the caregiver on the respective rails 554, 556. Such release levers or buttons associated with rail 556 may be positioned, for example, in the vicinity of handles 568 that are gripped by the caregiver to raise and lower sidewall portions 546.

Rails 554, 556 are movable to and lockable in a plurality of desired positions. For example, rails 554, 556 are lockable in the positions shown in FIG. 24 having a fairly large opening defined between rails 554, 556. From the positions shown in FIG. 24, rail 554 is movable downwardly in the direction of arrow 562 and rail 556 is movable upwardly in the direction of arrow 564 such that rails 554, 556 are lockable in fully-closed positions adjacent one another with a minimal gap, if any, therebetween. Alternatively, rail 556 may be moved from the position shown in FIG. 24 to a lower position, such as beneath mattress 18, to permit the patient to enter or exit bed enclosure 530. The spring bias of the upper and lower rollers ensures that the mesh material of sidewall portions 550, 552 are pulled taut relative to respective rails 554, 556 when rails 554, 556 are at any position within their range of positions.

Bed enclosure 530 includes a pair of upper end wall portions 568 and a pair of lower end wall portions 570 as shown in FIG. 24. Each upper end wall portion 568 includes a quantity of mesh material extending between a respective transverse frame member 572 and the respective arched top portion 533 of end frame members 534. In addition, each lower end wall portion 570 includes a quantity of mesh material and a transverse rail 574 coupled to an upper, transverse edge of the associated mesh material. The ends of rail 574 along with the end edges of the associated mesh material are received in respective slots (not shown) formed in the straight portions 535 of frame members 534.

Bed enclosure 530 further includes a pair of transverse rollers (not shown) on which respective lower end wall portions 570 wind/unwind. The transverse rollers are spring biased to rotate in the direction having the respective end wall portions 570 wound thereon. Suitable locking mechanisms and release mechanisms, are provided at the ends of rails 574 to lock and release rails 574 in the same manner that rails 554, 556 are locked and released. The release mechanisms associated with rails 574 may be located, for example, in the vicinity of handles 576 that are gripped by the caregiver to raise and lower end wall portions 570.

Figure 25:
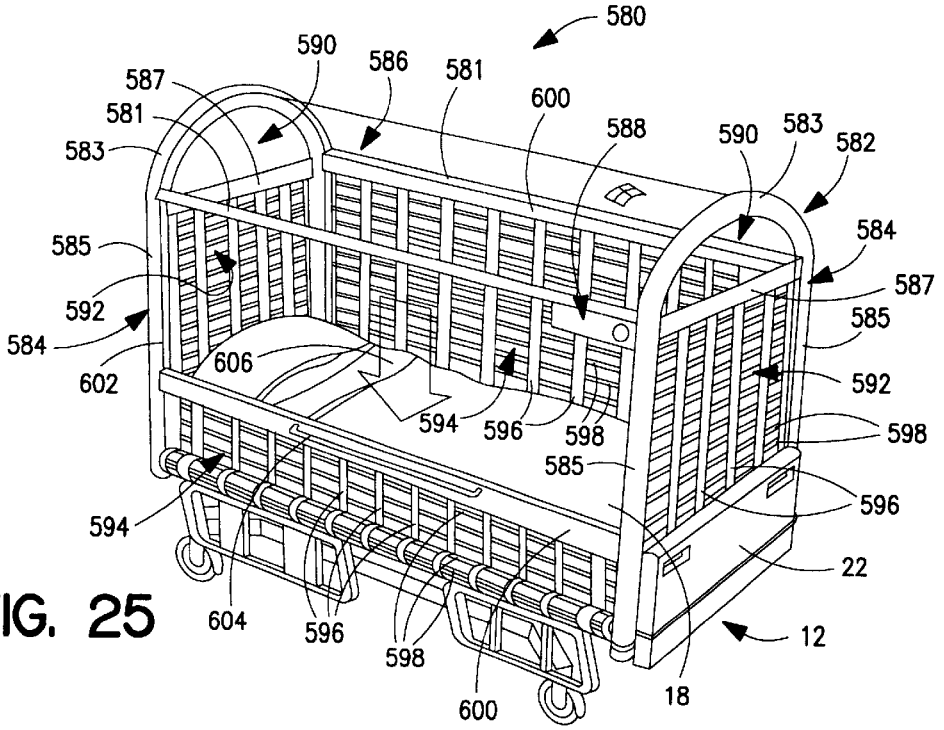

An alternative bed enclosure 580 includes a frame 582 having a pair of end frame members 584, each of which has an arched top portion 583 and straight vertical portions 585 extending downwardly from the respective arched top portion 583 as shown in FIG. 25. Frame 582 also includes a pair of longitudinal frame members 581 and a pair of transverse frame members 587 that are coupled to end frame members 584 in the region of transition between portions 583, 585 thereof. Suitable components (not shown), such as, for example, posts, pins, clamps, hooks, or latches, are provided for coupling frame 582 to an intermediate frame of bed 12 to raise and lower therewith. Bed enclosure 580 also includes a timer 588 that is substantially similar in function to timer 118 disclosed above in connection with bed enclosure 10.

Bed enclosure 580 includes an arched top wall 586 coupled to and extending between arched top portions 583 of frame members 584. Top wall 586 preferably is made from a clear plastic sheet of material. Bed enclosure 580 further includes a pair of upper end wall portions 590 coupled to and extending vertically between respective transverse frame members 587 and the associated arched top portions 583 of frame members 584. End wall portions 590 are also preferably made from a clear plastic sheet of material. Bed enclosure 580 includes a pair of lower end wall portions 592 extending between the respective straight vertical portions 585 of frame members 584 and extending between respective transverse frame members 587 and the lower portions (not shown) of frame members 584.

Bed enclosure 580 includes a pair of "roll-up" sidewalls 594 as shown in FIG. 25. Each sidewall 594 includes a quantity of hybrid mesh material having a plurality of vertical, transparent straps 596 and a plurality of horizontal, transparent chord or strand segments 598. Lower end wall portions 592 are made of this same hybrid mesh material. Each sidewall 594 also includes a longitudinal rail 600 coupled to an upper, longitudinal edge of the associated hybrid mesh material. The ends of each rail 600 along with the end edges of the associated hybrid mesh material are received in respective slots 602 formed in the frame members 584. Bed enclosure 580 further includes a pair of rollers (not shown) on which respective sidewalls 594 wind/unwind. The rollers each include components that spring bias the rollers to rotate in the direction having the respective sidewalls 594 wound thereon.

Suitable locking mechanisms, such as pins, hooks, clutches, or latches, are provided at the ends of rails 600 and engage frame members 584 to lock rails 600 in desired positions. Release levers or buttons (not shown) are coupled to corresponding locking mechanisms and are accessible to the caregiver on the respective rails 600. Such release levers or buttons associated with rails 600 may be positioned, for example, in the vicinity of handles 604 that are gripped by the caregiver to raise and lower sidewalls 594.

Rails 600 are movable to and lockable in a plurality of desired positions. For example, rails 600 are lockable in fully-closed positions such that rails are adjacent longitudinal frame members 581 with a minimal gap, if any, therebetween. From the fully-closed position, rails 600 are movable downwardly in the direction of arrow 606 to the position shown in FIG. 25 (with respect to one of rails 600) having a fairly large opening defined between rail 600 and the associated longitudinal frame member 581. Rails 600 may be moved from the position shown in FIG. 25 to an even lower position, such as beneath mattress 18, to permit the patient to enter or exit bed enclosure 580. The spring bias of the rollers ensures that the hybrid mesh material of sidewalls 600 are pulled taut relative to respective rails 600 when rails 600 are at any position within their range of positions.

Figure 26:
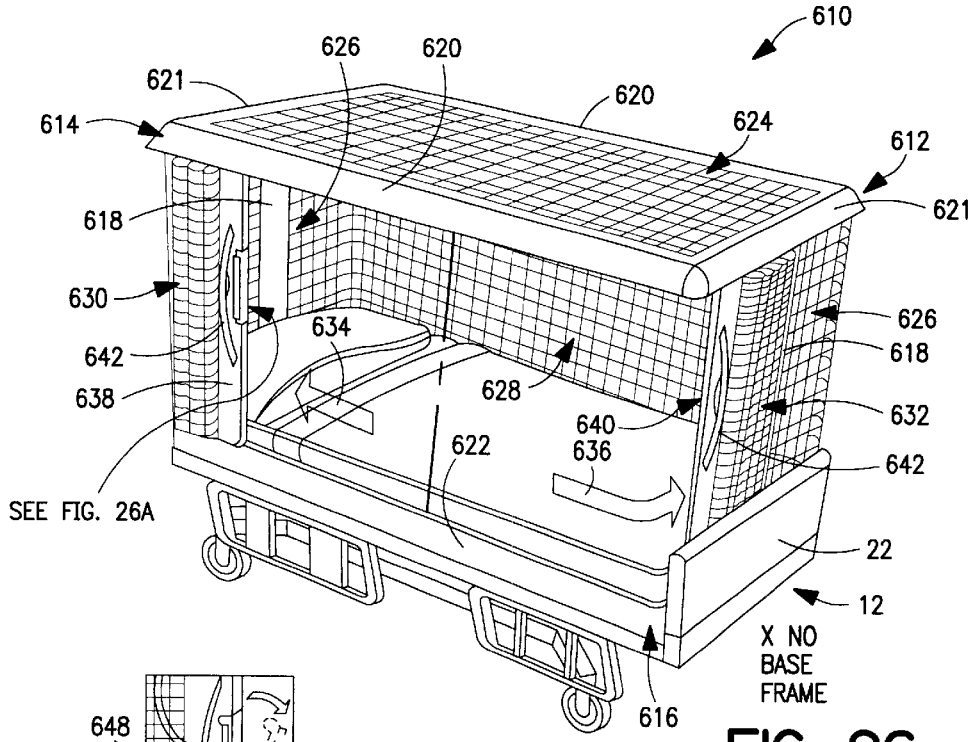

Another alternative bed enclosure 610 includes a frame 612 having an upper rectangular frame portion 614, a lower rectangular frame portion 616, and a pair of posts or vertical frame members 618 coupling rectangular frame portions 614, 616 together as shown in FIG. 26. Upper rectangular frame portion 614 includes a pair of longitudinal frame members 620 and a pair of transverse frame members 621. Similarly, lower rectangular frame portion 616 includes a pair of longitudinal frame members 622 and a pair of transverse frame members (not shown). The top ends of vertical frame members 618 connect to respective transverse frame members 621 and the bottom ends of vertical frame members 618 connect to the respective transverse frame members of lower rectangular frame portion 614. Suitable components (not shown), such as, for example, posts, pins, clamps, hooks, or latches, are provided for coupling frame 612 to an intermediate frame of bed 12 to raise and lower therewith.

Bed enclosure 610 includes a horizontal top wall 624 coupled to upper rectangular frame portion 614 as shown in FIG. 26. Illustratively, top wall 624 is made of a mesh material. Bed enclosure 610 also includes a first quantity of mesh material defining end wall portions 626 and defining one side wall 628. End wall portions 626 and sidewall 628 extend between frame portions 614, 616 and also extend from one of posts 618 to the other, thereby encompassing about half of the total amount of space encompassed by bed enclosure 610. Bed enclosure 610 further includes a head-end curtain 630 and a foot-end curtain 632. Curtains 630, 632 are openable in the directions of first and second arrows 634, 636, respectively, to permit a patient to enter or exit bed enclosure 610 and are closable in directions opposite to arrows 634, 636 respectively, to restrain a patient on bed 12.

Curtain 630 includes a quantity of mesh material and a vertical rail 638 coupled to one vertical edge of the associated mesh material. The other vertical edge of the mesh material of curtain 630 is coupled to post 616 at the head end of bed enclosure 610. Similarly, each curtain 632 includes a quantity of mesh material and a vertical rail 640 coupled to one vertical edge of the associated mesh material. The other vertical edge of the mesh material of curtain 632 is coupled to post 616 at the foot end of bed enclosure 610.

The upper and lower ends of respective vertical rails 638, 640 are received in tracks (not shown) that are formed in upper and lower rectangular frame portions 614, 616. In addition, a plurality of guide elements (not shown) are coupled at spaced-apart intervals to the upper and lower edges of the mesh material of respective curtains 630, 632 and extend therefrom into the tracks formed in frame portions 614, 616 to prevent separation of curtains 630, 632 from frame portions 614, 616. Examples of suitable guide elements include hooks, tethers having enlarged ends received in the tracks, chains coupled to enlarged balls received in the tracks, and roller assemblies having rollers that are received in the tracks.

The tracks in frame portions 614, 616 are formed such that, as curtains 630, 632 are opened, rails 638, 640 and the guide elements move in the tracks along an L-shaped path toward the respective posts 616 at the ends of bed enclosure 610. That is, when curtains 630, 632 are opened, rails 638, 640 and the guide elements move first in the portions of the tracks associated with longitudinal frame members 620, 621 and then move second in the portions of the tracks associated with each of upper transverse frame members 621 along with the tracks associated with the lower transverse frame members (not shown). As curtains 630, 632 are opened, the associated mesh material bunches or gathers together between the corresponding rails 638, 640 and the respective posts 616 as shown in FIG. 26. Of course as curtains 630, 632 are closed, the associated mesh material spreads out and rails 638, 640 along with the guide elements move away from the associated post 616.

Suitable locking mechanisms (not shown) are provided for locking rails 638, 640 in their respective closed positions. For example, pins, hooks, clutches, or latches may be provided at the ends of rails 638, 640 to engage frame portions 614, 616 to lock rails 638, 640 in their closed positions. Alternatively, pins, hooks, clutches, or latches may be provided on one of rails 638, 640 and may be movable to engage the other of rails 636, 640 to lock rails 638, 640 together when rails 638, 640 are in their closed positions. Release levers or buttons (not shown) are coupled to corresponding locking mechanisms and are accessible to the caregiver on the respective rails 638, 640. Such release levers or buttons associated with rails 638, 640 may be positioned, for example, in the vicinity of handles 642 that are coupled to each of rails 638, 640 and that are gripped by the caregiver to move curtains 630, 632 between the opened and closed positions.

Figure 26A:
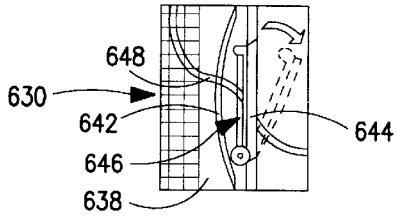
FIG. 26A is an enlarged detail view of FIG. 26, illustrating an arm pinned to a rail for guiding the curtain.

Rail 638 is formed to include a cut-out and an arm 644 is pinned at its bottom end to rail 638 as shown best in the enlarged portion of FIG. 26A. Arm 644 is movable between a first position, shown in FIG. 26A in solid, and a second position, shown in FIG. 26A in phantom. In the first position, arm 644 is received in the cut-out formed in rail 638 and a vertical slot 646 is defined between arm 644 and rail 638. When in the second position, arm 644 angles away from rail 638 such that a top end of arm 644 is spaced apart from rail 638 to allow an IV line 648 to be positioned in the cut-out formed in rail 638. After positioning IV line 648 in the cut-out, arm 644 is moved back to the first position, thereby trapping IV line 648 in slot 646. The upper end of arm 644 is provided with suitable structure, such as a detent mechanism, to engage rail 638 to hold arm 644 in the first position. Of course when curtains 630, 632 are in their closed positions, rail 640 is adjacent rail 638 which prevents arm 644 from moving out of the first position. Thus, by appropriately manipulating arm 644, the patient can enter and exit bed enclosure 610 without having to disconnect IV line 648 from the patient.

Figure 28:
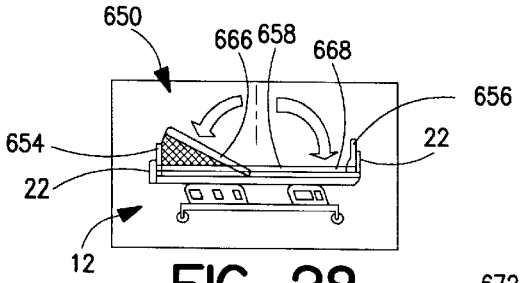
Figure 27:
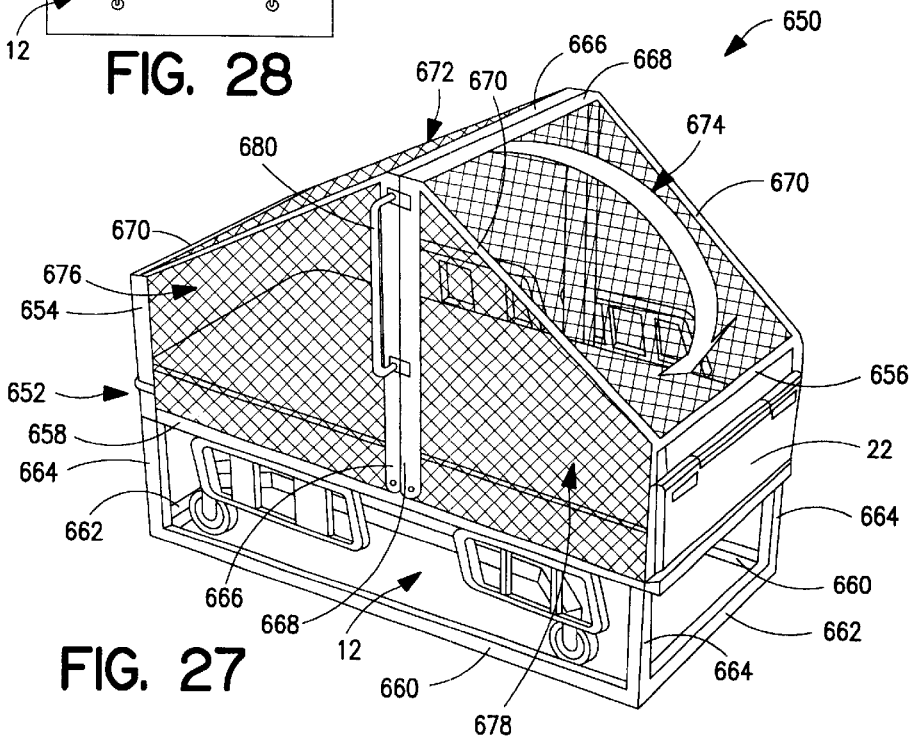

Yet another alternative embodiment bed enclosure 650 includes a frame 652 having a head end truss or panel 654 and a foot end truss or panel 656 that are positioned adjacent the respective end boards 22 of bed 12 as shown in FIGS. 27 and 28. Frame 652 further includes a pair of longitudinal frame members 658 extending between end panels 654, 656 along the sides of bed 12. Optionally, frame 652 includes longitudinal floor-engaging frame members 660, transverse floor-engaging members 662, and vertical frame members 664 that extend upwardly from frame members 660, 662 and that couple to respective panels 654, 656 as shown only in FIG. 27. In addition, frame 652 includes a first U-shaped frame member 666 and a second U-shaped frame member 668. The bottom ends of U-shaped frame members 666, 668 are pivotably coupled to frame members 658 such that frame members 666, 668 are movable between a first or closed position in which the side portions of frame members 666, 668 extend vertically adjacent one another as shown in FIG. 27 and an opened position in which the side portions of frame members 666, 668 extend horizontally adjacent frame members 658.

Bed enclosure 650 includes a plurality of flexible members 670, such as chords, straps, or bands, that extend from corner portions of frame members 666, 668 to respective corner portions of panels 654, 656 as shown in FIG. 27. Bed enclosure 650 further includes a first top wall portion 672 extending between a central portion of frame member 666 and a top edge of panel 654 and also extending between associated flexible members 670; a second top wall portion 674 extending between a central portion of frame member 668 and a top edge of panel 656 and also extending between associated flexible members 670; a pair of first sidewall portions 676 extending from respective side portions of frame member 666 to associated side edges of panel 654 and also extending from associated flexible members 670 to respective portions of frame members 658; and a pair of second sidewall portions 678 extending from respective side portions of frame member 668 to associated side edges of panel 656 and also extending from associated flexible members 670 to respective portion of frame members 658. Portions 672, 674, 676, 678 are preferably made from a mesh material. In addition, each of portions 672, 674, 676, 678 are pulled taut along with flexible members 670 to restrain the patient in bed enclosure 650 when frame members 666, 668 are in their respective closed positions.

When frame members 666, 668 are moved from their closed positions to their respective opened positions, portions 672, 674, 676, 678 go slack and bunch together between frame member 666, 668 and bed 12 as shown, for example, in FIG. 28. Bed enclosure 650 includes one or more handles 680 that are coupled to respective frame members 666, 668 and that are gripped by the caregiver to guide the movement of frame members 666, 668 between the opened and closed positions. In addition, bed enclosure 650 is provided with suitable locking mechanisms (not shown), such as pins, hooks, latches, or clamps, for locking frame members 666, 668 together when in their respective closed positions.

Figure 29:
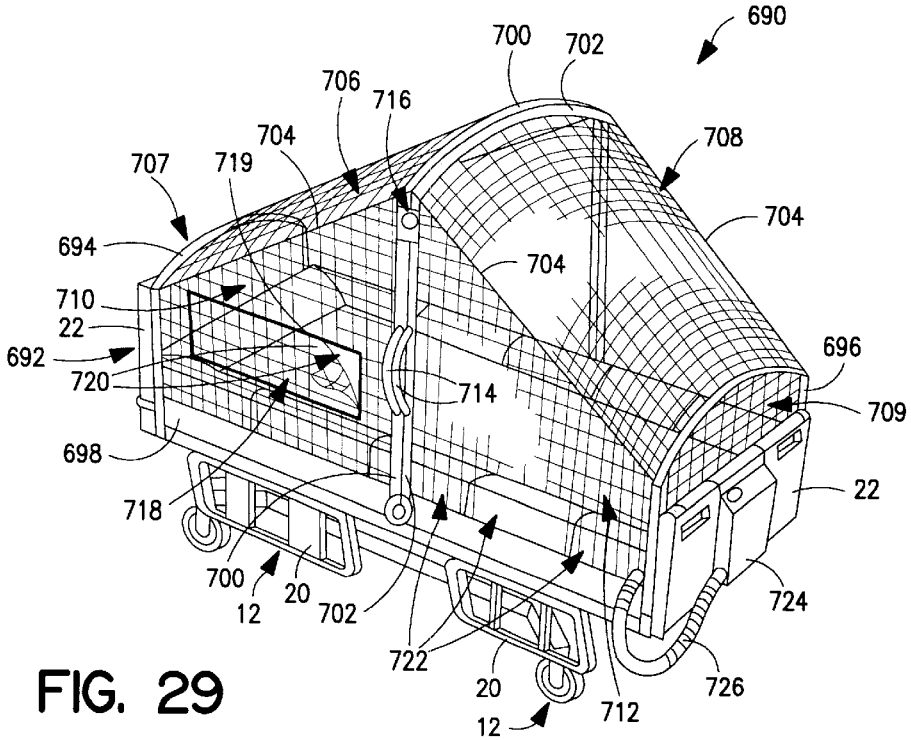

An alternative embodiment bed enclosure 690, which is similar to bed enclosure 650, includes a frame 692 having a head end truss 694 and a foot end truss 696 that are positioned adjacent the respective end boards 22 of bed 12 as shown in FIG. 29. Frame 692 further includes a pair of longitudinal frame members 698 extending between end trusses 694, 696 along the sides of bed 12. Frame 692 also includes suitable components (not shown), such as posts, pins, clamps, or latches, that couple frame 692 to the intermediate frame of bed 12 to raise and lower therewith. In addition, frame 692 includes a first U-shaped frame member 700 and a second U-shaped frame member 702. The bottom ends of U-shaped frame members 700, 702 are pivotably coupled to frame members 698 such that frame members 700, 702 are movable between a first or closed position in which the side portions of frame members 700, 702 extend vertically adjacent one another as shown in FIG. 29 and an opened position in which the side portions of frame members 700, 702 extend horizontally adjacent frame members 698.

Bed enclosure 690 includes a plurality of flexible members 704, such as chords, straps, or bands, that extend from corner portions of frame members 700, 702 to respective corner portions of trusses 694, 696 as shown in FIG. 29. Bed enclosure 690 further includes a first top wall portion 706 extending between an arched central portion of frame member 700 and a top arched portion of truss 694 and also extending between associated flexible members 704; a second top wall portion 708 extending between an arched central portion of frame member 702 and a top arcuate portion of truss 696 and also extending between associated flexible members 704; a pair of first sidewall portions 710 extending from respective side portions of frame member 700 to associated side portions of truss 694 and also extending from associated flexible members 704 to respective portions of frame members 698; and a pair of second sidewall portions 712 extending from respective side portions of frame member 702 to associated side portions of truss 696 and also extending from associated flexible members 704 to respective portions of frame members 698. In addition, a first endwall portion 707 is coupled to truss 694 and a second end wall portion 709 is coupled to truss 696.

Portions 706, 707, 708, 709, 710, 712 are preferably made from a mesh material. In addition, each of portions 706, 708, 710, 712 are pulled taut along with flexible members 704 to restrain the patient in bed enclosure 690 when frame members 700, 702 are in their respective closed positions. When frame members 700, 702 are moved from their closed positions to their respective opened positions, portions 706, 708, 710, 712 go slack and bunch together between frame members 700, 702 and bed 12. Bed enclosure 690 includes one or more handles 714 that are coupled to respective frame members 700, 702 and that are gripped by the caregiver to guide the movement of frame members 700, 702 between the opened and closed positions. In addition, bed enclosure 690 is provided with suitable locking mechanisms (not shown), such as pins, hooks, latches, or clamps, for locking frame members 700, 702 together when in their respective closed positions. An indicator or security light 716 is coupled to frame member 702 and provides a signal via a light when frame members 700, 702 are not locked together.

At least one of first sidewall portions 710 includes a flap 718 covering an access port 719 as shown in FIG. 29. Zipper segments 720 are provided around the periphery of flap 718 and port 719. Zipper segments 720 interact with one another in a conventional manner to open and close port 719. When flap 718 is unzipped and folded away from port 719, items can be passed to or received from the patient restrained by bed enclosure 690 without having to unlock and open frame members 700, 702.

Bed enclosure 690 also includes a plurality of inflatable air bladders 722 that extend inwardly from sidewall portions 710, 712 and end wall portions 707, 709 and that rest upon mattress 18 around its periphery as shown in FIG. 29. Illustratively, an air handling unit 724 is coupled to the end board 22 at the foot end of bed 12 and an air-delivery hose 726 extends from unit 724 to one of air bladders 722. Air bladders 722 are pneumatically coupled to one another so that air delivered by unit 724 through hose 724 inflates all of air bladders 722. Unit 724 includes conventional air-handling components (not shown), such as a compressor or fan, a manifold, valves, and one or more pressure sensors, that operate to inflate air bladders 722. When inflated, air bladders 722 serve as a resilient barrier between the patient and siderails 20 and end boards 22 of bed 12.

Figure 30:
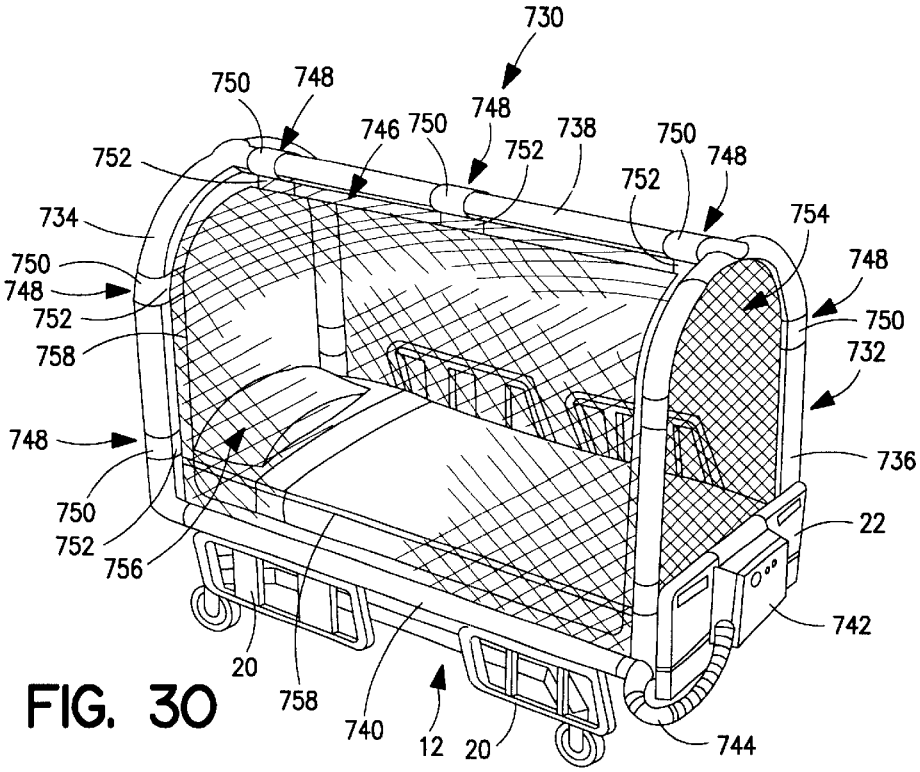

An alternative embodiment bed enclosure 730 includes an inflatable frame 732 having a first U-shaped bladder 734, a second U-shaped bladder 736, an upper longitudinal bladder 738 coupled to upper arched portions of bladders 734, 736, and a pair of lower longitudinal bladders 740 extending along the sides of bed 12 and coupled to lower ends of bladders 734, 736 as shown in FIG. 30. Optionally, frame 732 includes a pair of lower transverse bladders (not shown) extending along the ends of bed 12 and coupled to the lower ends of respective bladders 734, 736. Bed enclosure 730 includes suitable mechanisms, such as straps, posts, clamps, or latches, for coupling frame 732 to bed 12.

Illustratively, an air handling unit 742 is coupled to the end board 22 at the foot end of bed 12 and an air-delivery hose 744 extends from unit 742 to a junction formed between a lower end of one of the vertical side portions of bladder 736 and the foot end of one of bladders 740 as shown in FIG. 30. Air bladders 734, 736, 738, 740 are pneumatically coupled to one another so that air delivered by unit 742 through hose 744 inflates all of air bladders 734, 736, 738, 740. Unit 742 includes conventional air-handling components (not shown), such as a compressor or fan, a manifold, valves, and one or more pressure sensors, that operate to inflate frame 732. Frame 732 is inflated by unit 742 to a pressure that is sufficient to render frame 732 rigid enough to support the weight of the rest of bed enclosure 730 and to withstand incidental contact from the patient, caregiver, or equipment in the vicinity of bed 12.

Bed enclosure 730 includes an enclosing shell 746 and a plurality of collars 748 that couple shell 746 to frame 732 as shown in FIG. 30. Illustratively, each of bladders 734, 736, 738 are tubular elements and collars 748 each include a cylindrical sleeve 750 mounted on respective bladders 734, 736, 738. In addition, each collar 748 includes a flap or connector 752 that extends from the associated sleeve 750 and fastens to shell 746. Illustrative shell 746 is made from mesh material and includes vertical end wall portions 754 and a U-shaped covering portion 756 extending longitudinally between end wall portions 754. Shell 746 further includes a zipper 758 that permits a portion of covering portion 756 to be opened so the patient can enter and exit bed enclosure 730.

Figure 31:
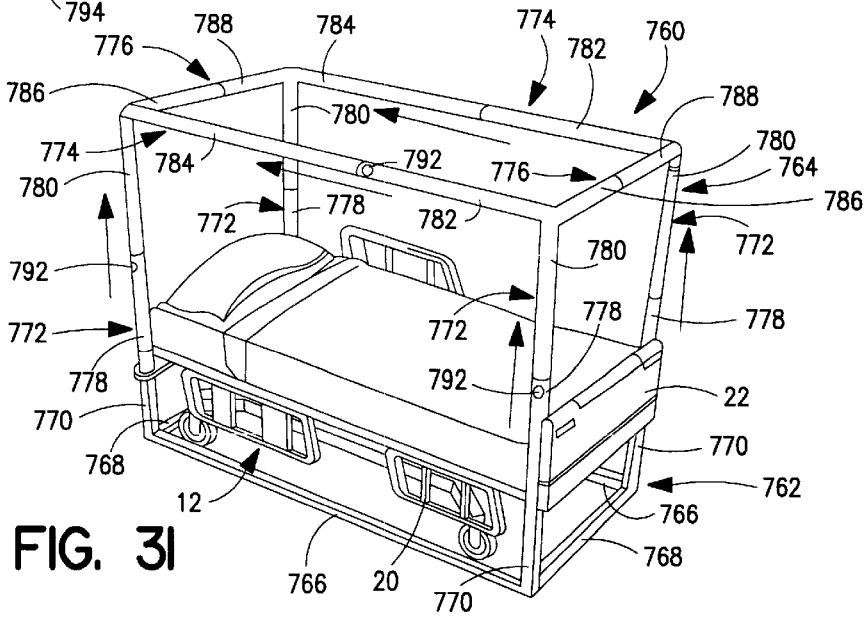

An alternative embodiment bed enclosure frame 760 includes a floor-engaging base 762 and a telescoping strut assembly 764 supported by base 762 as shown in FIG. 31. Base 762 includes a pair of longitudinal frame members 766 and a pair of transverse frame members 768 that are coupled to frame members 766 to form a rectangle. Base 762 further includes four vertical frame members 770 extending upwardly from the corners of the rectangle formed by frame members 766, 768. Strut assembly 764 includes four vertical telescoping struts 772 that couple to and extend upwardly from respective frame members 770. Strut assembly 764 further includes a pair of longitudinal telescoping struts 774 and a pair of transverse telescoping struts 776 that are coupled to struts 774 to from a rectangle. The top ends of struts 772 are coupled to the corners of the rectangle formed by struts 774, 776.

Figure 32:
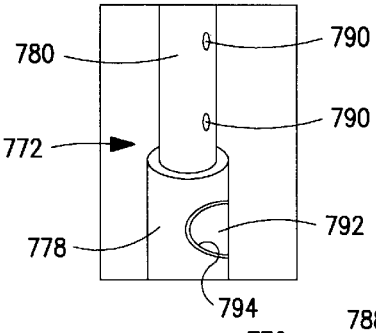

Vertical struts 772 each include a lower tube 778 and an upper tube 780 that extends out of and retracts into the associated lower tube 778. Longitudinal struts 774 each include a first tube 782 and a second tube 784 that extends out of and retracts into tube 782. Transverse struts 776 each include a first outer tube 786, a second outer tube 788, and an inner tube (not shown) retained within tubes 786, 788. Each of tubes 780 and tubes 784 are formed to include a plurality of apertures 790 as shown best in FIG. 32 with reference to one of vertical struts 772. In addition, each of struts 772, 774 include a release button or knob 792 that is coupled to a respective pin (not shown). Knobs 792 are each received in respective holes 794 formed in tubes 778, 782. Knobs 792 are gripped and retracted out of holes 794 to retract the pins from the corresponding apertures 790 which permits the lengths of the associated struts 772, 774 to be adjusted. When released, knobs 792 and the pins coupled thereto are spring biased inwardly so that the pins are received in the respective aperture 790 aligned therewith.

Because the lengths of struts 772, 774 are adjustable, strut assembly 764 is adjustable for use with beds of different sizes. Optionally, base 762 is omitted and strut assembly 764 couples to the intermediate frame of the associated bed 12. After strut assembly 764 is properly adjusted and coupled to the corresponding bed 12 or base 762, an enclosing shell (not shown) is slipped down over the top of frame 760 and fastened thereto. Thus, frame 760 allows for rapid set-up and tear-down of the bed enclosure in which frame 760 is included.

Figure 33:
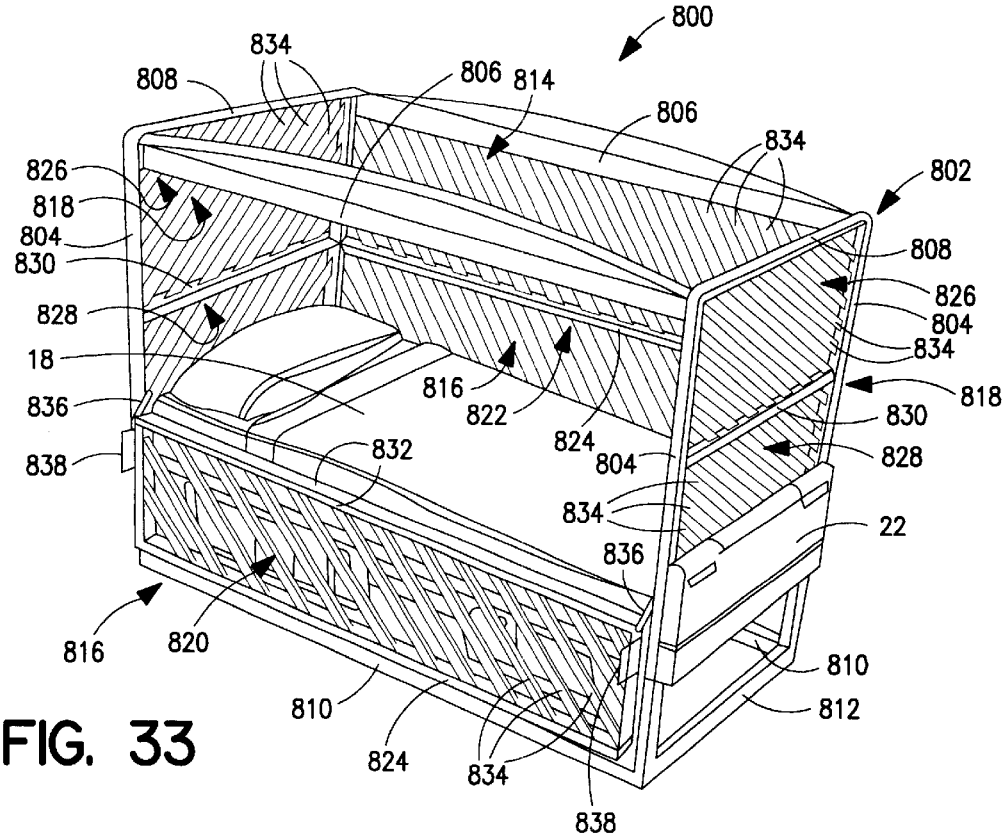

An alternative embodiment bed enclosure 800 includes a frame 802 having vertical frame members 804, upper longitudinal frame members 806, upper transverse frame members 808, lower longitudinal frame members 810, and lower transverse frame members 812 as shown in FIG. 33. Bed enclosure 800 also includes a transparent top wall 814, a pair of sidewalls 816, and a pair of end walls 818, all of which are coupled to frame 802. Each sidewall 816 includes an upper wall panel 820 and a lower wall panel 822 that is coupled to upper wall panel 820 by a longitudinally extending hinge 824. In addition, each end wall 818 includes an upper wall panel 826 and a lower wall panel 828 coupled to upper wall panel 826 by a transversely extending hinge 830. Each of wall panels 820, 822, 826, 828 includes a rectangular member 832 and a plurality of angled slats 834 coupled to member 832. Slats 834 preferably are made of a translucent plastic material, although slats 834 may be made of any suitably rigid material.

Lower wall panels 822, 828 are each pivotably coupled to frame 802 and are movable from a first vertical position extending above mattress 18 to a second vertical position extending beneath mattress 18. Of course panels 828 are constrained from pivoting in this manner when end boards 22 of bed 12 are mounted to the intermediate frame of bed 12. As lower wall panels 822, 828 are moved from the first vertical position to the second vertical position, upper wall panels 820, 826 pivot, via respective hinges 824, 830, relative to the corresponding lower wall panels 822, 828 from a first vertical position extending upwardly from respective lower wall panels 822, 828, as shown in FIG. 33 with reference to end walls 818, to a second vertical position extending vertically in side-by-side relation with the respective lower wall panels 822, 828, as shown in FIG. 33 with reference to one of sidewalls 816. Thus, sidewalls 816 and end walls 818 are collapsible from a closed positions having panels 820, 826 vertically aligned with respective panels 822, 828 to an opened position having panels 820, 826 folded against respective panels 822, 828.

Sidewalls 816 and end walls 818 are sized so that a generous amount of clearance exists between hinges 824, 830 (i.e. the lower portions of panels 820, 822, 826, 828) and the floor on which bed 12 sits when sidewalls 816 and end walls 818 are in the opened positions. In addition, sidewalls 816 and end walls 818 are sized so that panels 820, 822, 826, 828 are beneath the upper surface of mattress 18 when in their respective opened positions so as not to interfere with the patient's ingress onto mattress 18 or the patient's egress off of mattress 18.

A pair of arms or hooks 836, or other suitable components, are coupled to the upper edges of wall panels 820, 826 and extend therefrom into engagement with respective vertical frame members 804. Engagement between hooks 836 and frame members 804 prevents wall panels 820, 826 from moving away from frame 802 during opening and closing of sidewalls 816 and end walls 818. Suitable locking mechanisms (not shown), such as pins, hooks, latches, or clamps, are provided to lock sidewalls 816 and end walls 818 in their respective closed positions and suitable release mechanisms (not shown), such as levers, buttons, or switches, are provided for unlocking the locking mechanisms. Preferably, the release mechanisms are positioned in the vicinity of handles 838 that are gripped by the caregiver to guide the movement of the respective sidewalls 816 or end walls 818 during opening and closing thereof.

Figure 34:
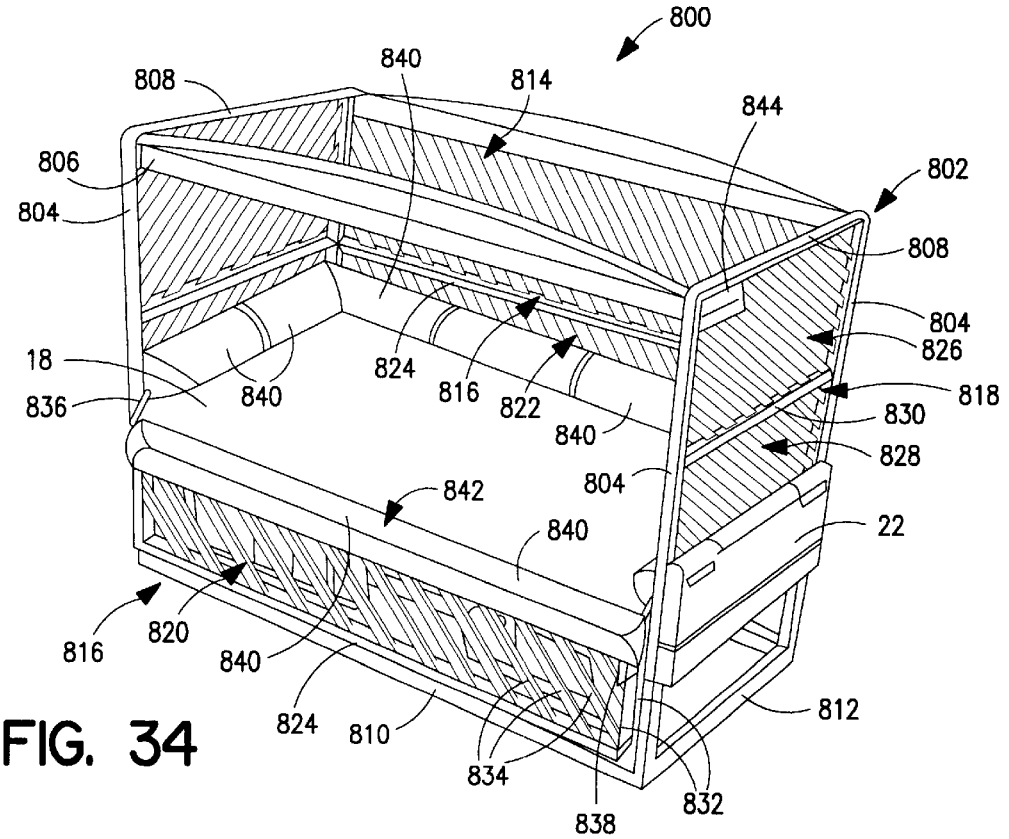

An alternative bed enclosure, shown in FIG. 34, is substantially similar to bed enclosure 800 and therefore like reference numerals are used to denote like components. Bed enclosure 800 of FIG. 34 includes a plurality of pouches 840 that are coupled to sidewalls 816 and end walls 818. Pouches 840 extend inwardly from walls 816, 818 and are sized to receive pillows or other padding material. In preferred embodiments, pouches 840 are sized to receive standard-size pillows. Pouches 840 each include slots (not shown) that are normally closed by zippers (not shown) but that are openable to permit insertion and removal of pillows 414 from pouches 840. Insertion of the pillows into pouches 840 provides a padded barrier between the patient and both the sidewalls 816 and end walls 818 of bed enclosure 800.

Illustratively, pouches 840 are made from a resilient, fluid-resistant or fluid-impermeable material for wipe-down cleaning. Each pouch 840 includes either a flap of material, strap, or tether that couples either to a portion of frame 802 or to lower wall panels 822, 828 such that pouches 840 are pivotable independently of the pivoting movement of wall panels 822, 828. Thus, after sidewalls 816 and end walls 818 are moved to their respective opened positions, pouches 840 are movable between a first position, in which a bottom surface 842 of the respective pouch 840 rests upon a portion of the periphery of mattress 18, and a second position, in which the respective pouch 840 is flipped outwardly away from mattress 18 as shown in FIG. 34 with reference to the set of pouches 840 along one of the sides of bed enclosure 800. Preferably, bottom surfaces 842 of pouches 840 are substantially coplanar with the top surface of mattress 18 when pouches 840 are in their second positions. Placing pouches 840 in their second positions facilitates patient ingress onto mattress 18 and facilitates patient egress off of mattress 18.

Bed enclosure 800 includes a CPR release handle 844 coupled to frame 802 at the foot end of bed enclosure 800 adjacent an upper corner formed by one of frame members 804 and one of frame members 808 as shown in FIG. 34. Handle 844 is coupled, such as by cables or rods, to one or more of the locking mechanisms that engage arms 836 to lock the respective sidewalls 816 and end walls 818 in their closed positions. Actuation of CPR release handle 844 unlocks the locking mechanisms so the associated sidewalls 816 and end walls 818 drop rapidly to their opened positions. Illustratively, only one of sidewalls 816 drops from its closed position to its opened position when handle 844 is actuated. Caregivers typically will actuate handle 844 when the patient restrained by bed enclosure 800 goes into cardiac arrest so that a caregiver team has immediate access to the patient to administer cardiopulmonary resuscitation. Those skilled in the art will appreciate that levers, buttons, switches, or knobs may be included on bed enclosures 800 for unlocking the locking mechanisms in lieu of handles 844 and are therefore, equivalent to handles 844.

Figure 35:
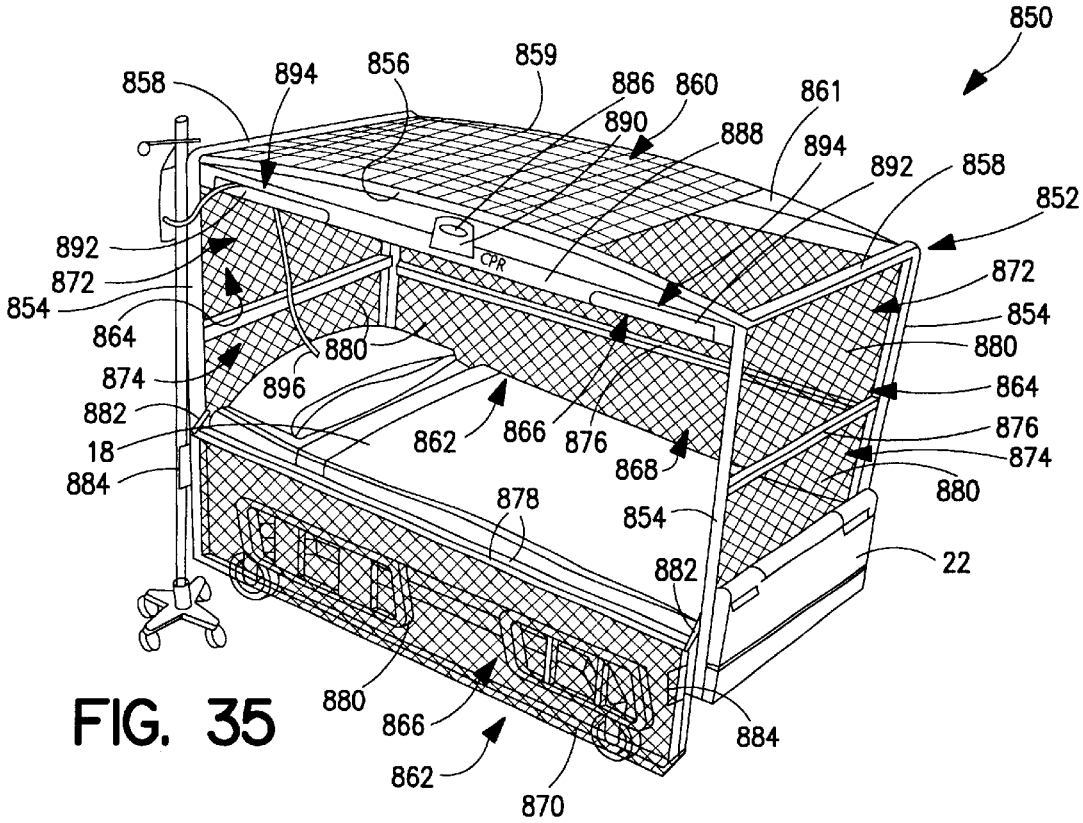

Another alternative embodiment bed enclosure 850 includes a frame 852 having vertical frame members 854, arched upper longitudinal frame members 856, and upper transverse frame members 858 as shown in FIG. 35. Frame 852 also includes lower longitudinal frame members (not shown) extending along the sides of the intermediate frame of bed 12 and lower transverse frame members (not shown) extending along the ends of the intermediate frame of bed 12. The lower transverse frame members of frame 852 are connected to the lower longitudinal frame members of frame 852 to form a rectangle that is coupled to the intermediate frame of bed 12 to raise and lower therewith.

Bed enclosure 850 includes a top wall 860 coupled to frame 852 and having a mesh portion 859 and a transparent portion 861 at the foot end thereof to enhance the ability of the patient to view a television located outside of bed enclosure 850. Bed enclosure 850 also includes a pair of sidewalls 862 and a pair of end walls 864, both of which are coupled to frame 852. Each sidewall 862 includes an upper wall panel 866 and a lower wall panel 868 that is coupled to upper wall panel 866 by a longitudinally extending hinge 870. In addition, each end wall 864 includes an upper wall panel 872 and a lower wall panel 874 coupled to upper wall panel 872 by a transversely extending hinge 876. Each of wall panels 866, 868, 872, 874 includes a rectangular member 878 and a quantity of mesh material 880 coupled to member 878.

Lower wall panels 868, 874 are each pivotably coupled to frame 852 and are movable from a first vertical position extending above mattress 18 to a second vertical position extending beneath mattress 18. Of course panels 874 are constrained from pivoting in this manner when end boards 22 of bed 12 are mounted to the intermediate frame of bed 12. As lower wall panels 868, 874 are moved from the first vertical position to the second vertical position, upper wall panels 866, 872 pivot, via respective hinges 870, 876, relative to the corresponding lower wall panels 868, 874 from a first vertical position extending upwardly from respective lower wall panels 868, 874, as shown in FIG. 35 with reference to end walls 864, to a second vertical position extending vertically in side-by-side relation with the respective lower wall panels 868, 874, as shown in FIG. 35 with reference to one of sidewalls 862. Thus, sidewalls 862 and end walls 864 are each collapsible from a closed position having panels 866, 872 vertically aligned with respective panels 868, 874 to an opened position having panels 866, 872 folded against respective panels 868, 874.

A pair of arms or hooks 882, or other suitable components, are coupled to the upper edges of wall panels 866, 872 and extend therefrom into engagement with respective vertical frame members 854. Engagement between arms 882 and frame members 854 prevents wall panels 866, 872 from moving away from frame 852 during opening and closing of sidewalls 862 and end walls 864. Suitable locking mechanisms (not shown), such as pins, hooks, latches, or clamps, are provided to lock sidewalls 862 and end walls 864 in their respective closed positions and suitable release mechanisms (not shown), such as levers, buttons, or switches, are provided for unlocking the locking mechanisms. Preferably, the release mechanisms are positioned in the vicinity of handles 884 that are gripped by the caregiver to guide the movement of the respective sidewalls 862 or end walls 864 during opening and closing thereof.

Bed enclosure 850 includes a longitudinal member or panel 888 positioned just beneath one of frame members 856 and a CPR release button 886 is coupled to panel 888 at a central region thereof between the ends of bed enclosure 850 as shown in FIG. 35. Button 886 is coupled, such as by cables or rods, to one or more of the locking mechanisms that lock the respective sidewalls 862 and end walls 864 in their closed positions. Actuation of CPR release button 886 unlocks the locking mechanisms so the associated sidewalls 862 and end walls 864 drop rapidly to their opened positions. Illustratively, only one of sidewalls 862 drops from its closed position to its opened position when button 886 is actuated. Those skilled in the art will appreciate that levers, handles, switches, or knobs may be included on bed enclosures 850 for unlocking the locking mechanisms in lieu of buttons 886 and are therefore, equivalent to buttons 886.

Illustratively, button 886 is mounted to a plate 890 that is coupled to panel 888 and button 886 is actuated when a patient goes into cardiac arrest to release the locking mechanisms that are remote from button 886. However, it is within the scope of this disclosure for plate 890 to pivot relative to panel 888 and for plate 890 to be spring biased into engagement with member 878 of panel 866 of sidewall 862 to lock sidewall 862 in its closed position. In such an alternative embodiment, plate 890 serves as a simple latching mechanism that is pivoted relative to panel 888 against the spring bias to unlock the associated sidewall 862 for movement from the closed position to the opened position.

Panel 888 is formed to include a pair of cutouts, one on each side of button 886, and bed enclosure 850 includes a pair of arms 892 that are pivotably coupled to panel 888 for movement between respective first positions, shown in FIG. 35, and respective second positions (not shown). In their first positions, arms 892 are received in the associated cut-outs formed in panel 888 such that horizontal slots 894 are defined between arms 892 and the corresponding portions of panel 888. In their second positions, arms 892 angle downwardly away from panel 888 such that a distal end of each arm 892 is spaced apart from panel 888 to allow an IV line 896 to be positioned in the desired cut-out formed in panel 888. After positioning IV line 896 in the desired cut-out, the respective arm 892 is moved back to the first position, thereby trapping IV line 896 in the associated slot 894. The distal end of each arm 892 is provided with suitable structure, such as a detent mechanism, to engage panel 888 to hold the respective arm 892 in the first position. Of course when the respective sidewall 862 is locked in its closed position, member 878 is adjacent panel 888 which prevents arms 892 from moving out of their first positions. Thus, by appropriately manipulating arms 892, the patient can enter and exit bed enclosure 850 without having to disconnect IV line 896 from the patient.

Figure 36:
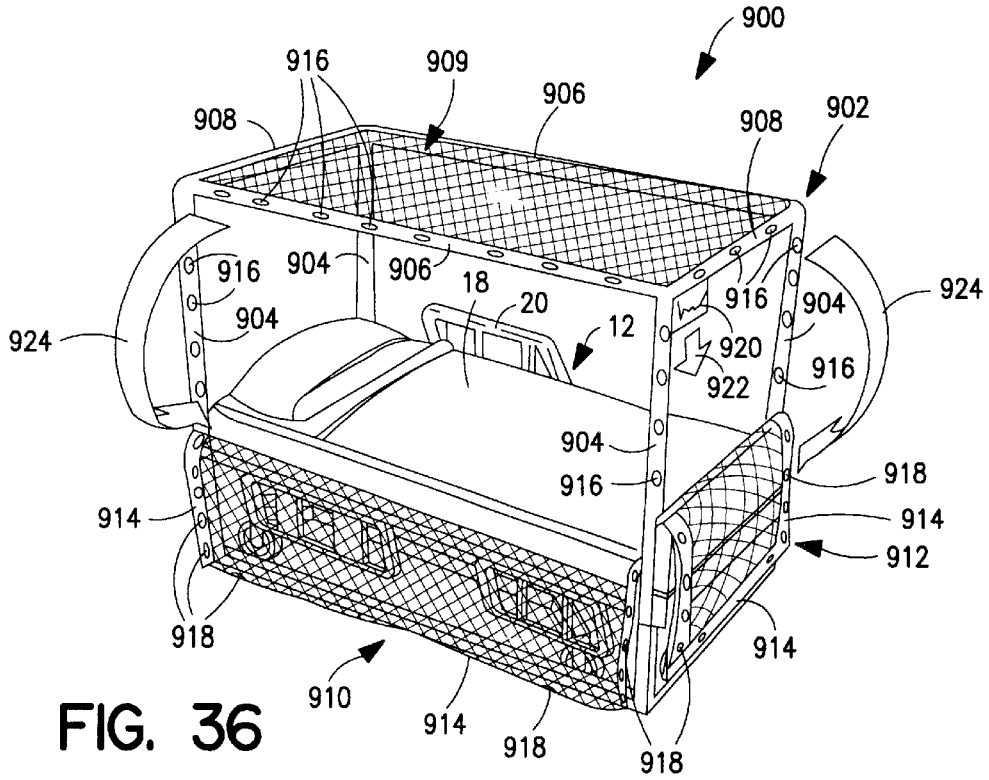

Yet another alternative bed enclosure 900 includes a frame 902 coupled to bed 12 and having vertical frame members 904, upper longitudinal frame members 906, and upper transverse frame members 908 as shown in FIG. 36. Bed enclosure also includes a top wall 909, a pair of sidewalls 910, and a pair of end walls 912 that couple to frame 902 to enclose and restrain the patient supported by mattress 18 of bed 12. Sidewalls 910 and end walls 912 each include a quantity of mesh material and perimeter portions 914 that are made from a flexible material, such as cloth or vinyl, to which the mesh material couples. Illustratively, top wall 909 is also made of a quantity of mesh material.

Bed enclosure 900 includes a plurality of locking mechanisms, each having a first portion 916 associated with respective frame members 904, 906, 908 and a second portion 918 associated with perimeter portions 914 of sidewalls 910 and end walls 912 as shown diagrammatically in FIG. 36. First portions 916 interact with respective second portions 918 to lock sidewalls 910 and end walls 912 to frame 902. It is understood that portions 916, 918 of the plurality of locking mechanisms may be any structure capable of coupling sidewalls 910 and end walls 912 to frame 902. For example, second portions 918 may be eyelets or posts and first portions 916 may be hooks, latches, or pins that capture the eyelets or posts to retain perimeter portions 914 against frame 902. Thus, second portions 918 may include elements that extend from perimeter portions 914, first portions 916 may include elements that are positioned to lie inside the interior regions of frame members 904, 906, 908, and frame members 904, 906, 908 may include a plurality of openings (not shown) in which second portions 918 are received to engage first portions 916.

Bed enclosure 900 includes a CPR release handle 920 coupled to frame 902 at the foot end of bed enclosure 900 adjacent an upper corner formed by one of frame members 904 and one of frame members 908 as shown in FIG. 36. Handle 920 is coupled, such as by cables, rods, or links to each first portion 916 of the locking mechanisms that engage respective second portions 918 to lock the respective sidewalls 910 and end walls 912 in their closed positions. Actuation of CPR release handle 920 in a direction indicated by arrow 922 simultaneously manipulates each first portion 916 to disengage from each respective second portion 918, thereby unlocking the locking mechanisms which permits the associated sidewalls 910 and end walls 912 to fall away from frame 902 under the force of gravity in the directions indicated by arrows 924. Preferably, at least one of sidewalls 910 includes a zippered flap that is opened to permit the patient to enter and exit bed enclosure 900 without having to actuate handle 920.

Although the invention has been described with reference to certain embodiments, variations exist within the scope and spirit of the invention as described and defined in the following claims.

What is claimed is:

1. A bed enclosure for use with a hospital bed having a frame, an intermediate frame vertically adjustable relative to the frame, an articulating deck pivotally mounted to the intermediate frame, and a mattress, the bed enclosure comprising:

a shell having a roof, a bottom panel, a wall connected to and extending between the bottom panel and the roof, and a curtain formed in the wall, the curtain being movable relative to a remainder of the wall between a lowered position to form an opening providing access between the interior and exterior of the shell and a raised position in which the shell forms a complete enclosure, and a skeletal structure supporting the shell and being attached to the intermediate frame of the bed.

2. The apparatus of claim 1, wherein the bottom panel of the shell rests on and extends across the articulating deck, the mattress rests on the bottom panel, the curtain is movable between the lowered position in which a top edge of the curtain is below a top surface of the mattress of the bed to which the bed enclosure is attached and the raised position in which the shell forms a complete enclosure within which the mattress is received.

3. The apparatus of claim 2 and further comprising a pad having a flexible flap connected to the shell, the flap and pad being configured so that the pad is positionable on the top surface of the mattress when the curtain is in the raised position and the pad is positionable below the top surface of the mattress when the curtain is in the lowered position.

4. The apparatus of claim 1, further comprising an I.V. slot formed in the wall of the shell adjacent to the movable curtain, the I.V. slot being configured to allow a patient with an I.V. attached to enter and exit the bed to which the shell of the bed enclosure is attached without removal of the I.V. from the patient.

5. The apparatus of claim 1, wherein the curtain includes a top edge and the top edge is configured to be secured to the remainder of the wall when in the raised position.

6. The apparatus of claim 5, further comprising a zipper having a first row of teeth attached to the top edge of the curtain and a second row of teeth attached to the remainder of the wall so that the zipper secures the top edge to the remainder of the wall when the curtain is in the raised position.

7. The apparatus of claim 6, further comprising a sensor for producing an illumination signal when the zipper is not fully closed, and at least one light coupled to the shell which is illuminated when the sensor produces the illumination signal.

8. The apparatus of claim 1, wherein the bottom panel is configured to facilitate pivoting of the articulating deck relative to the intermediate frame.

9. The apparatus of claim 1 wherein the skeletal structure includes telescoping cross-members configured to alter the length of the skeletal structure in response to an alteration in the length of the intermediate frame.

10. The apparatus of claim 1, wherein the curtain includes a patient access port and a mechanism for closing the patient access port.

11. The apparatus of claim 10, wherein the mechanism for closing the patient access port comprises a zipper.

12. The apparatus of claim 1, wherein the curtain is releasably securable at a stop position intermediate the lowered position and the raised position.

13. The apparatus of claim 12, further comprising a vertically extending rod, and a handle supported by the curtain and guided in movement by the rod.

14. The apparatus of claim 1, further comprising pads enclosing the skeletal structure.

15. The apparatus of claim 1, further comprising a timer coupled to the shell and a reset button for reinitializing the timer.

16. The apparatus of claim 1, wherein the wall includes at least one pouch extending into the interior of the enclosure with an opening accessible from the exterior of the enclosure.

17. The apparatus of claim 16, further comprising at least one pillow inserted through the at least one opening into the pouch.

18. The apparatus of claim 16, wherein the at least one pouch includes a transparent document window.

19. A bed enclosure for use with a hospital bed having a frame and a mattress, the bed enclosure comprising:

a shell having a pair of vertically extending walls, a curtain formed in at least one of the walls, and a connector connecting the pair of walls to one another and extending below the mattress to secure the pair of walls relative to the mattress, the curtain being movable relative to a remainder of the at least one wall between a first position to form an opening providing access between the interior and exterior of the shell and a second position in which the shell forms a complete enclosure, and means for supporting the shell, the means being supported by the frame of the bed.

20. The apparatus of claim 19, wherein:

a mattress including a top surface is supported by the intermediate frame of the bed, the curtain includes a top edge, and the curtain is movable between the first position in which the top edge of the curtain is below the top surface of the mattress and the second position in which the shell forms a complete enclosure within which the mattress is received.

21. The apparatus of claim 19, wherein the curtain includes a top edge and the top edge is configured to be secured to the remainder of the wall when the curtain is in the second position.

22. The apparatus of claim 19, wherein the curtain includes a patient access port and a mechanism for closing the patient access port.

23. The apparatus of claim 19, wherein the curtain is releasably securable at a stop position intermediate the first position and the second position.

24. The bed enclosure of claim 19, wherein the connector extends substantially an entire length of the mattress.

25. The bed enclosure of claim 19 wherein the connector is planar.

26. The bed enclosure of claim 19 wherein the connector includes a panel having pair of edges respectively connected to the pair of walls.

27. A bed enclosure for use with a hospital bed having a frame and a mattress including a top surface supported by the frame, the bed enclosure comprising:

a shell including a vertically extending wall and a curtain having a top edge formed in the wall, the curtain being movable relative to a remainder of the wall between a first position in which the top edge is below the top surface of the mattress to form an opening providing access between an interior and an exterior of the shell and a second position in which the shell forms a complete enclosure within which the mattress is received, a support configured to couple the shell to the frame of the bed, and a pad having a flexible flap connected to the shell, the flap and the pad being configured so that the pad is positionable on the top surface of the mattress when the curtain is in the second position and the pad is positionable below the top surface of the mattress when the curtain is in the first position.

28. A bed enclosure for use with a hospital bed having a frame and a mattress, the bed enclosure comprising:

a shell having a vertically extending wall and a curtain formed in the wall, the curtain being movable relative to a remainder of the wall between a first position to form an opening providing access between the interior and exterior of the shell and a second position in which the shell forms a complete enclosure, a support configured to couple the shell to the frame of the bed, and a slot formed within the wall adjacent the curtain, the slot being configured to receive tubes which are attached to a patient so that the patient can enter and exit the bed enclosure without removing the tubes from the patient.

29. A bed enclosure for use with a hospital bed having a frame and a mattress, the bed enclosure comprising:

a shell having a vertically extending wall and a curtain formed in the wall, the curtain being movable relative to a remainder of the wall between a first position to form an opening providing access between the interior and exterior of the shell and a second position in which the shell forms a complete enclosure, wherein the curtain includes a top edge and the top edge is configured to be secured to the remainder of the wall when the curtain is in the second position, a support configured to couple the shell to the frame of the bed, and a zipper having a first row of teeth attached to the top edge of the curtain and a second row of teeth attached to the remainder of the wall so that the zipper secures the top edge to the remainder of the wall when the curtain is in the second position.

30. A bed enclosure for use with a hospital bed having a frame and a mattress, the bed enclosure comprising:

a shell having a vertically extending wall, a curtain formed in the wall, and a bottom panel connected to the wall and configured to conform to pivoting movement of an articulating deck of the bed, the curtain being movable relative to a remainder of the wall between a first position to form an opening providing access between the interior and exterior of the shell and a second position in which the shell forms a complete enclosure, and a support configured to couple the shell to the frame of the bed.

31. A bed enclosure for use with a hospital bed having a frame and a mattress, the bed enclosure comprising:

a shell having a vertically extending wall and a curtain formed in the wall, the curtain being movable relative to a remainder of the wall between a first position to form an opening providing access between the interior and exterior of the shell and a second position in which the shell forms a complete enclosure, a support configured to couple the shell to the frame of the bed, and wherein the support includes a skeletal structure having cross-members configured to alter the length of the skeletal structure.

32. The apparatus of claim 31, wherein each of the cross-members comprise at least-two telescopically connected components.

33. A bed enclosure for use with a hospital bed having a frame and a mattress, the bed enclosure comprising:

a shell having a pair of vertically extending walls, a curtain formed in at least one of the walls, and a connector extending below the mattress to secure the pair of walls relative to the mattress, the connector engaging a lower surface of the mattress, the curtain being movable relative to a remainder of the at least one wall between a first position to form an opening providing access between the interior and exterior of the shell and a second position in which the shell forms a complete enclosure, and means for supporting the shell, the means being supported by the frame of the bed.

* * * * *